US005750950A

United States Patent [19]

Nogami et al.

[11] Patent Number: 5,750,950

[45] Date of Patent: May 12, 1998

[54] HYDRAULIC DRIVE DEVICE FOR CIRCUIT BREAKER AND CIRCUIT BREAKER USING THE SAME

[75] Inventors: Tadahiko Nogami, Mito; Goro Daimon, Hitachi; Yasuhide Takeda, Hitachi; Hideo Kawamoto, Hitachi; Kouichi Sadou, Hitachi; Hiroshi Maeda, Hitachi; Hiroyoshi Sadamura, Ibaraki-ken, all of Japan

[73] Assignee: Hitachi, Ltd., Tokyo, Japan

[21] Appl. No.: 713,117

[22] Filed: Sep. 16, 1996

[30] Foreign Application Priority Data

Sep. 20, 1995 [JP] Japan ..... 7-241247

[51] Int. Cl.[6] ..... H01H 33/02; H01H 33/34; H01H 33/68

[52] U.S. Cl. ..... 218/154; 200/148 E; 200/148 F; 200/82 B; 200/148 B

[58] Field of Search ..... 218/154; 200/82 B, 200/148 B, 148.5, 148 D, 148 E, 148 R, 150

[56] References Cited

U.S. PATENT DOCUMENTS 3,555,279 1/1971 Mamz et al. ..... 200/150
3,823,286 7/1974 Turk et al. ..... 200/82 B

FOREIGN PATENT DOCUMENTS 59-8224 1/1984 Japan .

*Primary Examiner*—Peter S. Wong
*Assistant Examiner*—Rajnikant B. Patel
*Attorney, Agent, or Firm*—Antonelli, Terry, Stout, & Kraus, LLP

[57] ABSTRACT

Occurrence of erroneous operation in which circuit closing operation unexpectedly happens after circuit opening operation even though an abnormality such that a circuit closing system is left in a circuit closing condition even after completion of the circuit closing operation. Accordingly, a circuit closing control valve has such an arrangement that its pilot chamber becomes a low pressure so that the circuit closing control valve is opened, and a lock valve having two pilot chambers connected to a circuit closing pilot valve and a circuit opening pilot valve, which are both become a low pressure, is located in a passage connecting between the pilot chamber of the circuit opening control valve and a return port. With this arrangement, if the above-mentioned abnormality occurs, the circuit closing condition is maintained unless a circuit opening instruction is delivered, and once the circuit opening operation is effected, the lock valve is opened so as to connect the pilot chamber of the circuit opening control valve to the lower pressure side so that the circuit opening control valve is left to be opened in order to disable the circuit closing operation, thereby it is possible to prevent occurrence of erroneous operation.

18 Claims, 14 Drawing Sheets

HYDRAULIC DRIVE DEVICE FOR CIRCUIT BREAKER AND CIRCUIT BREAKER USING THE SAME

BACKGROUND OF THE INVENTION

The present invention relates to an electric power circuit breaker, in particular to a hydraulic drive device which prevents erroneous circuit closing operation after circuit opening operation.

In a hydraulic drive device for a circuit breaker which is provided for instantly cutting off high electric power so as to protect a power supply system, not only high speed circuit opening operation should be carried out but also the circuit opening condition should be held unless a proper circuit closing instruction is delivered after the circuit opening operation, that is, the circuit closing operation should never happen unexpectedly. However, if a circuit closing condition still continues even after completion of circuit closing operation as for example a circuit closing instruction is not canceled due to any abnormality which occurs in the circuit closing system, the circuit closing condition would again occur after a circuit opening system is restored after completion of a predetermined circuit opening operation, that is, an erroneous operation accident in which circuit closing operation happens unexpectedly possibly occurs.

Accordingly, a conventional hydraulic drive device is provided therein with a mechanism of for preventing the above-mentioned erroneous operation, that is, its circuit closing system is provided with a lock valve, as disclosed in, for example, Japanese Laid-Open Patent No. 59-8224, so that a passage in the circuit closing system is closed with a lag of a predetermined time after a circuit closing control valve or a main control valve is changed over into a circuit closing position during circuit closing operation, and, accordingly, the passage is never opened unless a circuit closing instruction is canceled.

In the above-mentioned conventional arrangement, the lock valve is always actuated not only upon occurrence of an abnormality but also during circuit closing operation in a normal condition. Accordingly, the lock valve should be arranged to be closed with a lag of predetermined time after the circuit closing control valve or the main control valve is changed over into the circuit closing position so that the circuit closing operation of the circuit closing control valve or the main control valve is prevented from being hindered by the operation of the lock valve. Thus, there has been taken such a measure that the time or speed of the closing operation of the lock valve is retarded with the use of a restrictor valve.

However, with the above-mentioned arrangement, the operating characteristic of the lock valve must be adjusted with the use of the restrictor valve or the like, and accordingly, there have been raised problems in reliability, that is, the characteristics become uneven, depending upon results of the adjustment, or the characteristics vary, depending upon a temperature, use frequency or the like, and so forth.

SUMMARY OF THE INVENTION

Accordingly, one object of the present invention is to provide a highly reliable hydraulic drive device for a circuit breaker and a circuit breaker which can eliminate the above-mentioned problems inherent to the prior art, which can surely prevent occurrence of erroneous operation wherein the circuit closing operation unexpectedly happens after circuit opening operation, and which can eliminate the necessity of adjusting the characteristic of a lock valve.

To the end, according to the present invention, a hydraulic drive device for a circuit breaker, comprises a hydraulic cylinder for opening and closing a contact, a hydraulic power source for pressurizing and feeding working fluid, and control valves for controlling the flow of the working fluid fed from the hydraulic power source so as to drive the above-mentioned hydraulic cylinder, wherein the above-mentioned control valves include circuit closing system valves for causing the contact to fall into a circuit closing condition, circuit opening system valves for causing the contact to fall into a circuit opening condition, and means for holding the circuit opening condition of the above-mentioned circuit opening system valves so as to disable the circuit closing operation of the above-mentioned circuit closing system valves after the circuit opening operation in the case of the circuit opening operation by the circuit opening system valves when the circuit closing system valves and the like are in the circuit closing condition.

Thus, the circuit closing system valves are the generic name of valves which cause the contact to fall into a circuit closing condition, and can be composed of a circuit closing control valve, a circuit closing pilot valve for actuating the former and the like in combination. Similarly, the circuit opening system valves are the generic name of valves for causing the contact to fall in the circuit opening condition, and can be composed of a circuit opening control valve, a circuit opening pilot valve for actuating the former and the like in combination.

Further, a lock valve may be used as the means for disabling the circuit closing operation of the circuit closing system valves.

Preferably, in order to attain the above-mentioned objects, the hydraulic drive device for a circuit breaker according to the present invention, comprises a hydraulic cylinder for opening and closing a contact, a hydraulic power source for pressurizing and feeding working fluid, and control valves for controlling the flow of the working fluid fed so as to drive the above-mentioned hydraulic cylinder, wherein the above-mentioned control valves include a main control valve for controlling the supply and discharge of the working fluid into and from the hydraulic cylinder, a circuit closing control valve receiving a circuit closing instruction for the contact, for connecting a pilot chamber of the main control valve with a supply port, and a circuit closing pilot valve for connecting a pilot chamber in the circuit closing control valve with a return port for effecting the above-mentioned connecting operation, a circuit opening control valve receiving a circuit opening instruction for the contact, for connecting the pilot chamber of the main control valve with the return port and a circuit opening pilot valve for connecting the pilot chamber in the circuit opening control valve with the return port for the above-mentioned connecting operation, a passage connecting the pilot chamber of the circuit opening control valve to the return port, and a lock valve connected to the passage, wherein the lock valve is opened in such a case that the pilot chamber in the circuit opening control valve is connected to the return port in a condition in which the pilot chamber in the circuit closing control valve is connected with the return port, the connection of the pilot chamber in the circuit opening control valve with the return port is maintained so as to disable the circuit closing operation of the circuit closing control valve.

With this arrangement, the secondary side of the lock valve may be connected to the return port, and the above-mentioned passage is provided so as to connect the above-mentioned pilot chamber in the circuit opening control valve with the primary side of the lock valve, thereby the opening operation of the lock valve causes the pilot chamber of the circuit opening control valve to be connected to the return port.

Further, the above-mentioned passage may be provided so that the pilot chamber in the circuit opening control valve is connected to the primary side of the lock valve, and further, the secondary side of the lock valve is connected to the primary side of the circuit opening control valve, thereby the pilot chamber in the circuit opening control valve is connected to the return port when the lock valve and the circuit opening control valve are opened.

In the above-mentioned arrangement, the primary side of the valve corresponds to a side where the working fluid flows into, and the secondary side of the valve corresponds to a side where the working fluid flows out. Further, the opening operation of the valve is such an operation that allows the working fluid to flow from the primary side to the secondary side, and the closing operation is such an operation that cuts off the flow of the working fluid from the primary side to the secondary side. Further, the opening and closing of the contact are distinguished from each other, and accordingly, are called as circuit opening and circuit closing, respectively. Further, the valve normally incorporates two pilot chambers on opposite sides of a valve element, for driving the valve element, that is, the valve element is driven by maintaining the pressure of one of the pilot chambers at a constant pressure while changing the pressure of the other of the pilot chambers, that is, the valve element is driven through the balance between forces acting upon the valve element. Unless otherwise specified, the latter pilot chamber will be simply denoted hereinafter "the pilot chamber".

With this arrangement, in such a case that the circuit opening pilot chamber is opened so as that the second pilot chamber in the lock valve falls in a low pressure condition, the pressure of the first pilot chamber of the lock valve when initiating the opening operation of the lock valve is preferably set to a value which is higher than the pressure of the first pilot chamber in the circuit closing control valve. Accordingly, the lock valve can be actuated before the circuit closing control valve is left being opened.

Further, instead of the provision of the above-mentioned passage and the lock valve, a passage connecting between the pilot chamber in the circuit opening control valve and the primary side is provided, and a stop valve is connected to this passage also in order to prevent occurrence of erroneous operation, and in this case, since the stop valve doesn't work until the circuit opening control valve is opened, the stop valve can be opened before the circuit opening control valve is opened.

Further, the this stop valve may be a valve which is opened in response to an external instruction, and specifically, a means for monitoring an operating condition of the hydraulic drive device is provided, and the stop valve may be opened in response to an alarm issued from the monitoring means. At this time, the opening operation can be made either automatically or electrically in response to the alarm or manually by an operator who receives the alarm, through remote control or the like.

The circuit closing and circuit opening pilot valves are connected at their primary side to the supply port through its restrictor valve, and are connected at their secondary side to the return port, and the lock valve may have a first pilot chamber connected to the primary side of the circuit closing pilot valve, a second pilot chamber connected to the primary side of the circuit opening pilot valve, and a third pilot chamber being opposed to the first and second pilot chambers across the valve element. With this arrangement, the lock valve is automatically opened in association with detection such that the circuit closing pilot valve is in a circuit closing condition and the circuit opening pilot valve carries out an circuit opening operation.

Further, the lock valve may be a poppet valve having a valve seat at its bottom, and a hole for receiving the valve element therein is formed having a constant bore so that the valve element can be fitted in the hole by a predetermined depth from the valve seat, and the forward end thereof may have a diameter larger than the bore. With this arrangement, even though variation in pressure is caused in the pilot chamber in the lock valve during circuit closing operation in a normal condition so that the valve element is slightly driven in the operating direction thereof, the lock valve is never opened, thereby it is possible to prevent the circuit opening control valve from being erroneously operated, that is, it is possible to prevent occurrence of circuit opening operation of the contact.

Further, the above-mentioned lock valve is provided so as to take a motion orthogonal to the direction of motion of the hydraulic cylinder. With this arrangement, it is possible to reduce interference in operation between the hydraulic cylinder and the lock valve.

Further, the circuit breaker is constituted by causing the contact to carry out circuit opening operation or circuit closing operation with the use of the hydraulic drive device for a circuit breaker.

In a hydraulic drive device for a circuit breaker, is arranged to perform circuit opening operation of the contact prior to circuit closing operation thereof. Accordingly, in such a case that the circuit closing system valves are in a circuit closing condition, and the circuit opening system valves preform a circuit opening operation, the circuit closing operation can be thereafter disabled by holding the circuit opening system valves in the circuit opening condition. With this arrangement, it is possible to prevent occurrence of erroneous operation (pumping operation) in which the contact unexpectedly carries out circuit closing operation after circuit opening operation.

Further, with a specific means, when a circuit closing instruction for the contact is delivered, the circuit closing pilot valve is opened connecting the pilot chamber in the circuit closing control valve to the return port so as to move the valve element (opening operation), and as a result, the pilot chamber in the main control valve is connected to the supply port. Further, when a circuit opening instruction for the contact is delivered, the circuit opening pilot valve is opened connecting the pilot chamber in the circuit opening control valve to the return port so as to move the valve element (opening operation), and as a result, the pilot chamber in the main control valve is connected to the return port.

When the pilot chamber in the main control valve is connected to the supply port, the valve element in the main control valve is moved to a position where the working fluid is fed into the hydraulic cylinder which therefore carries out the circuit closing operation for the contact. Further, when the pilot chamber in the main control valve is connected to the return port, the valve element in the main control valve is moved to a position where the working fluid is discharged from the hydraulic cylinder, and accordingly, the hydraulic cylinder carries out the circuit opening operation for the contact.

At this time, the lock valve still maintains the connection of the pilot chamber in the circuit opening control valve with the return port even after the circuit opening pilot valve is returned for closing, by opening an erroneous operation preventing passage connecting the pilot chamber in the circuit opening control valve to the return port, in such a case that the pilot chamber in the circuit closing control valve is connected to the return port (circuit opening condition) in a condition in which the pilot chamber in the circuit closing control valve is connected to the return port (circuit closing condition). Accordingly, the circuit closing operation of the contact by the circuit closing control valve is disabled, and therefore, it is possible to prevent occurrence of erroneous operation (pumping operation) in which the contact unexpectedly carries out the circuit closing operation after circuit opening operation.

Further, the erroneous operation preventing means (pumping operation preventing means) such as the lock valve, the stop valve or the like which are used in the present invention, has a structure which cannot be operated in a normal operating condition in which the control valves falls in either the circuit opening condition or the circuit closing condition. Thus, the operating characteristics of the erroneous operation preventing means does not hinder the normal circuit opening operation or circuit closing operation of the contact. Accordingly, it is possible to eliminate the necessity of consideration for the operating characteristic of the lock valve, in particular, the adjustment for the operation timing with respect to other valves constituting the control valves with the use of a restrictor valve or the like, and affection caused by variation in the characteristic caused by a temperature, a used frequency or the like, and further, it is possible to provide a hydraulic drive device for a circuit breaker, and a circuit breaker, having a high degree of reliability or a circuit As stated above, according to the present invention, even though any abnormality occurs so that the circuit closing system is left in a circuit closing operating condition, it is possible to surely prevent erroneous operation in which the circuit closing operation happens unexpectedly after circuit opening operation. Thus, the adjustment for the operating characteristic of the erroneous operation preventing means or the lock valve is not required, and further, the characteristic does not vary, thereby it is possible to practically provide a hydraulic drive device for a circuit breaker, having a high degree of reliability.

DESCRIPTION OF THE PREFERRED EMBODIMENTS

Figure 1:
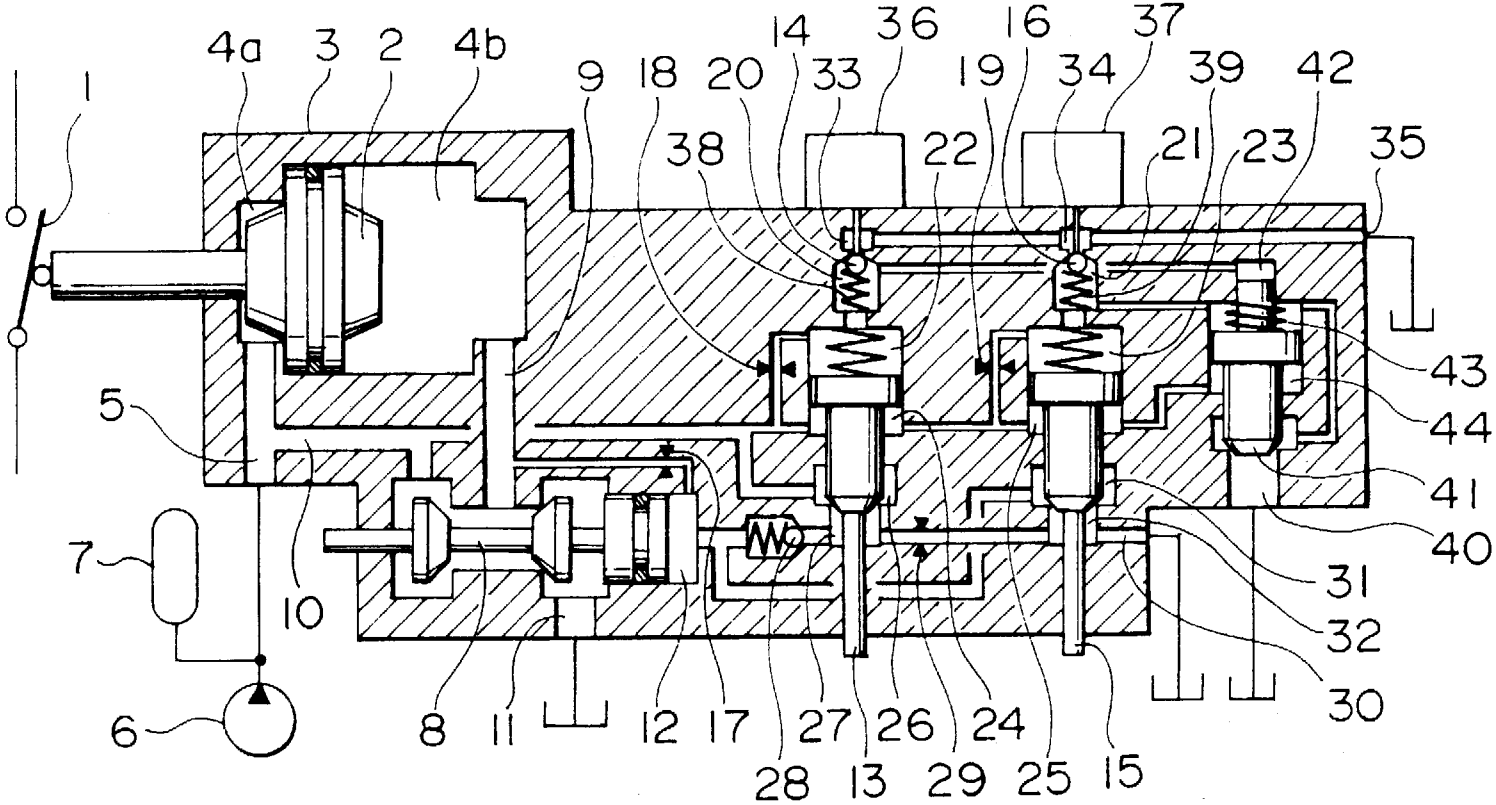
FIG. 1 is a structural view illustrating an embodiment of the present invention in a normal circuit closing holding condition.

Explanation will be hereinbelow made of an embodiment of the present invention as to a hydraulic drive device for a circuit breaker and an erroneous operation preventing mechanism with reference FIG. 1 to FIG. 6.

The structure of this embodiment will be at first explained.

A high pressure is always fed to a small pressure receiving area side 4*a* of a hydraulic cylinder 3 having a piston 2 for opening and closing a contact 1, through a supply port 5 from a hydraulic pump 6 and an accumulator 7 which constitutes a hydraulic power source while a large pressure receiving area side defining an actuating chamber 4*b* is connected to a control port 9 of a main control valve 8 so as to feed and discharge working fluid into and from the large pressure receiving area side 4*b*. With this arrangement, when the working fluid is fed into the large pressure receiving area side 4*b*, the contact 1 is closed, and when the working fluid is discharged therefrom, the contact 1 is opened.

In the main control valve 8, a high pressure is always applied to the rear surface of a poppet on the supply port 10 side communicated with the supply port 5, the control port 9 is selectively connected to the supply port 10 or a return port 11 by supplying and discharging the working fluid into and from a pilot chamber 12 in the main control valve. The main control valve 8 is changed over into a circuit closing position by means of circuit closing system valves composed of a circuit closing control valve 13 and a circuit closing pilot valve 14, and is changed over into a circuit opening position by means of circuit opening system valves composed of a circuit opening control valve 15 and circuit opening pilot valve 16. Further, the pilot chamber 12 in the main control valve is connected to the control port 9 communicated with the actuating chamber 4*b* in the hydraulic cylinder 3 through a restrictor valve 17.

Each of the circuit closing control valve 13 and the circuit opening control valve 15 is composed of a large diameter part, a middle diameter part and a small diameter part, and a poppet valve is formed at the forward end of the middle diameter part. The large diameter part is formed therein with first pilot chambers 22, 23 which are connected to the supply port through restrictor valves 18, 19 and which are connected to primary sides 20, 21 of the circuit closing pilot valve 16, and which produce forces for closing the control valves when a high pressure is effected therein. The part between the large diameter part and the middle diameter part is formed therein with second pilot chambers 24, 25 connected to the supply port so that a large pressure for producing forces for opening the control valves is always effected therein.

The primary side 26 of a poppet valve part of the circuit closing control valve 13 is connected to the supply port, and the secondary side 27 thereof is connected to the pilot chamber 12 of the main control valve through a check valve 28 and further, is connected to a return port 20 through a restrictor valve 29. The primary side 31 of the circuit opening control valve 15 is connected to the pilot chamber 12 in the main control valve, and the secondary side 32 thereof is connected to the return port 30. The primary sides 33, 34 of the circuit closing pilot valve 14 and the circuit opening pilot valve 16 are connected to the return port 35, and are pressed for opening, respectively by a circuit closing drive means 36 and a circuit opening drive means 37, and are urged for closing, respectively by springs 38, 39.

Meanwhile, a lock valve 41 is provided in a passage connecting between the primary side 21 of the circuit opening pilot valve 16 communicated with the first pilot chamber 23 of the circuit opening control valve 15, and a return port 40. The lock valve 41 is composed of a large diameter part, a middle diameter part and a small diameter part, the middle diameter part being formed at its forward end with a poppet valve, the primary side being connected to the primary side 21 of the circuit opening pilot valve 16 communicated with the first pilot chamber 23 of the circuit opening control valve 15 and the secondary side being connected to the return port 40.

The lock valve 41 has a first pilot chamber 42 applying a pressure to the small diameter part, a second pilot chamber 43 for applying a pressure to a part between the large diameter part and the small diameter pat, and a third pilot chamber 44 for applying a pressure in a part between the large diameter part and the middle diameter part so as to generate a force countering the first and second pilot chambers. The first pilot chamber 42 is connected to the primary side 20 of the circuit closing pilot valve 14, the second pilot chamber 43 is connected to the primary side 21 of the circuit opening pilot valve 16 communicated with the first pilot chamber 23 of the circuit opening pilot chamber 15, and the third pilot chamber 44 is connected to the supply port. The third pilot chamber 44 is held at a high pressure so as to generate a force for pushing up as view in the drawings the lock valve 41 in order to open this valve, but when a high pressure is applied to at least either one of the first pilot chamber 42 and the second pilot chamber 43, a force for depressing the lock valve 43 is generated as viewed in the drawings, so as to close this valve. Thus, the pressure receiving area of the third pilot chamber 44 is smaller than either one of the first pilot chamber 42 and the second pilot chamber 43.

It is noted that hydraulic pump 6 is to accumulate high pressure working fluid in the accumulator 7, starting its operation when the working fluid accumulated in the accumulator 7 is slightly decreased so that the pressure lowers below a predetermined lower limit value, but stopping its operation when the pressure is restored up to a predetermined upper limit value. Accordingly, the working fluid is fed through the supply port 5 mainly from the accumulator 7 during operation of the control valves and the hydraulic cylinder.

Further, since the circuit opening operation is set to be preferentially executed, the flow rate of the working fluid flowing out from the circuit opening control valve is higher than that flowing into from the circuit closing control valve When both circuit opening and closing valves are opened. Further, springs provided in the circuit closing control valve 13, the circuit opening control valve 15 and the lock valve 41 are adapted to close these valves so that the working fluid is prevented from flowing into the return port side when the hydraulic pump 6 is started to energize the device from a condition in which the all pressures are released.

Next, the operation in a normal condition of the present embodiment will be hereinbelow described with reference to FIGS. 1 to 4.

When a circuit opening instruction is delivered in a circuit closing holding condition as shown in FIG. 1, the circuit opening drive means 37 pushes and opens the circuit opening pilot valve 16 so that the working fluid flows from the primary side 21 to the secondary side 34. At this time, the working fluid flows into from the supply port through the restrictor valve 19, the primary side 21 and the first pilot chamber 23 of the circuit opening control valve 15 communicated with the primary sid 21 become lower pressure since the opening on the flow outlet side is larger than that on the flow inlet side, and accordingly, the circuit opening control valve 15 is opened by an actuating force applied from the second pilot chamber 25.

When the circuit opening control valve 15 is opened, the working fluid is discharged from the pilot chamber 12 of the main control valve to the return port 30 by way of the primary side 31 and the secondary side 32 so that the pilot chamber 12 of the main control valve becomes low pressure, and accordingly, the main control valve 8 is changed over into the circuit opening position so that the working fluid is discharged from the actuating chamber **4*b* of the hydraulic cylinder 3. Thus, the piston 2 starts the circuit opening operation by the pressure applied to the small pressure receiving area side 4*a*, and, accordingly, the condition shown in FIG. 2** is effected.

When the circuit opening instruction is canceled so that the drive force of the circuit opening drive means 37 is eliminated, the circuit opening pilot valve 16 is pushed by the spring 39 and accordingly, is closed. Then, the working fluid is fed through the restrictor valve 19 to the primary side 21 which therefor becomes a high pressure, and accordingly, the circuit opening pilot valve 16 is more firmly held to be closed. Further, since the first pilot chamber 23 of the circuit opening control valve 15 becomes higher, the circuit opening control valve 15 is closed, overcoming the actuating force of the second pilot chamber 25. However, since the pilot chamber 12 of the main control valve is connected to the control pot 9 which has already become lower pressure through the restrictor valve 17, the main control valve 8 is held at the circuit opening position, and accordingly, the piston 2 continues the circuit opening operation so as to effect the circuit opening holding condition as shown in FIG. 3.

During the above-mentioned circuit opening steps in series, the first pilot chamber 43 of the lock valve 41 connected to the primary side 20 of the circuit closing valve 14 is always held at a high pressure, and accordingly, it always overcomes the actuating force of the third pilot chamber having a small pressure receiving area even though the first pilot chamber 23 of the circuit opening control valve 15 and the second pilot chamber 43 connected to the primary side 21 of the circuit opening pilot valve 16 become low pressure, thereby the lock valve 41 will not be opened. Further, a low pressure is applied at one side of the piston 2 while a high pressure is applied at the other side of the piston 2 so that a large drive force is produced, and further, since the working fluid is accumulated in the accumulator 7 by a sufficient volume, the piston 2 opens the contact 1 at an extremely high speed, thus, the electric power can be cut off, instantly.

Figure 3:
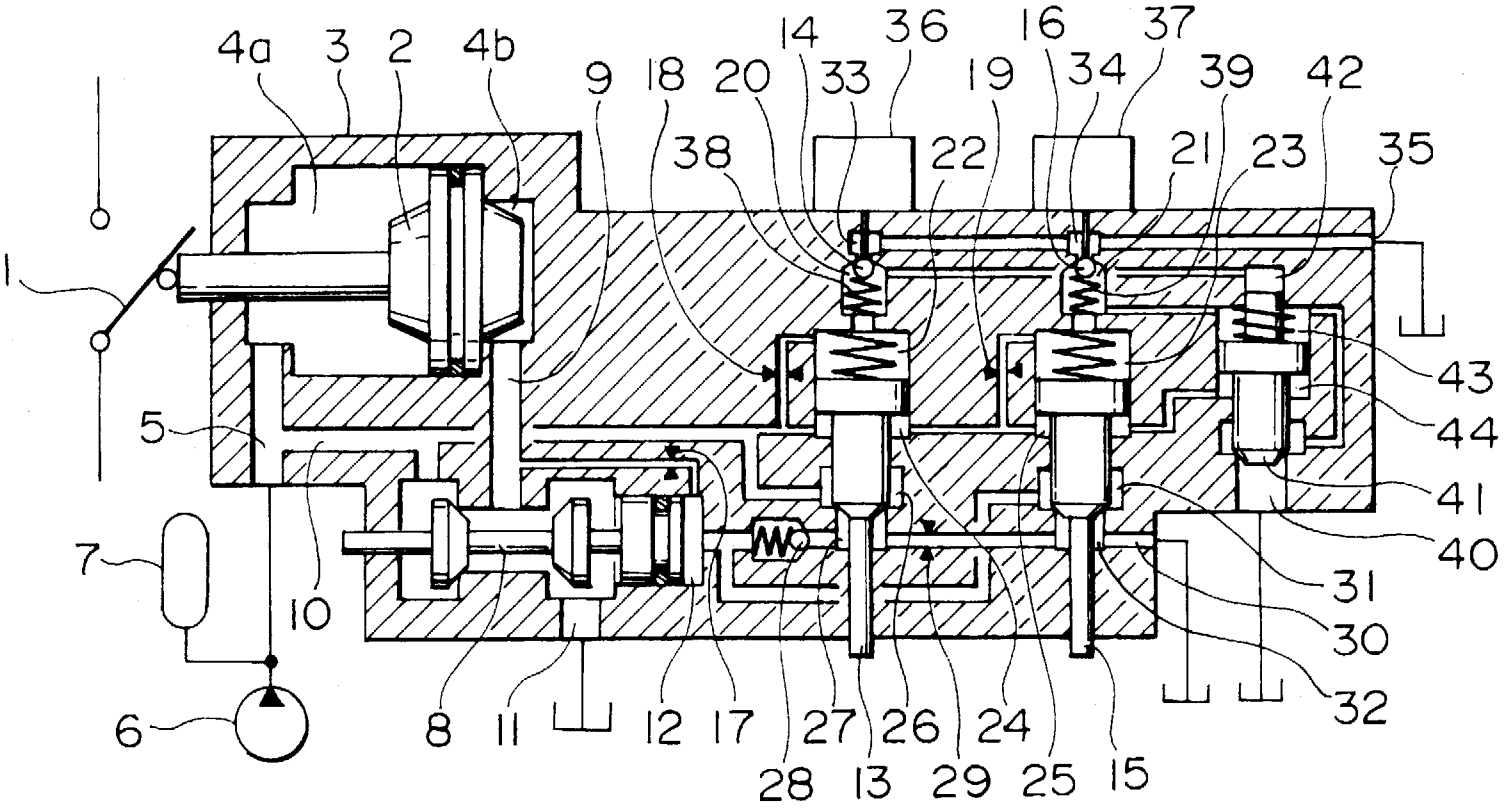
FIG. 3 is a structural view illustrating the embodiment shown in FIG. 1 in a normal circuit opening holding condition.
Figure 4:
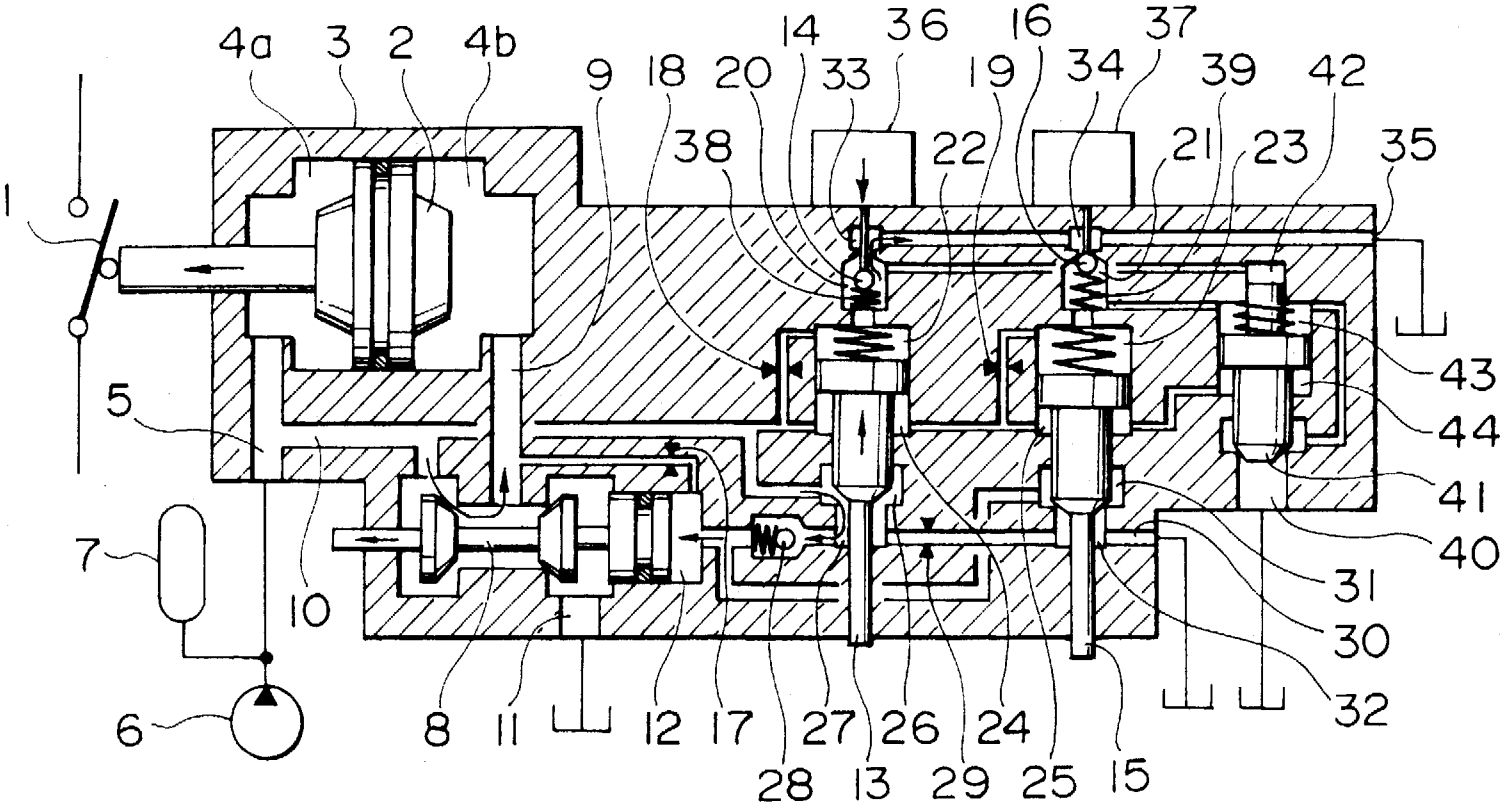
FIG. 4 is a structural view illustrating the embodiment shown in FIG. 1 in a normal circuit closing condition.
Figure 5:
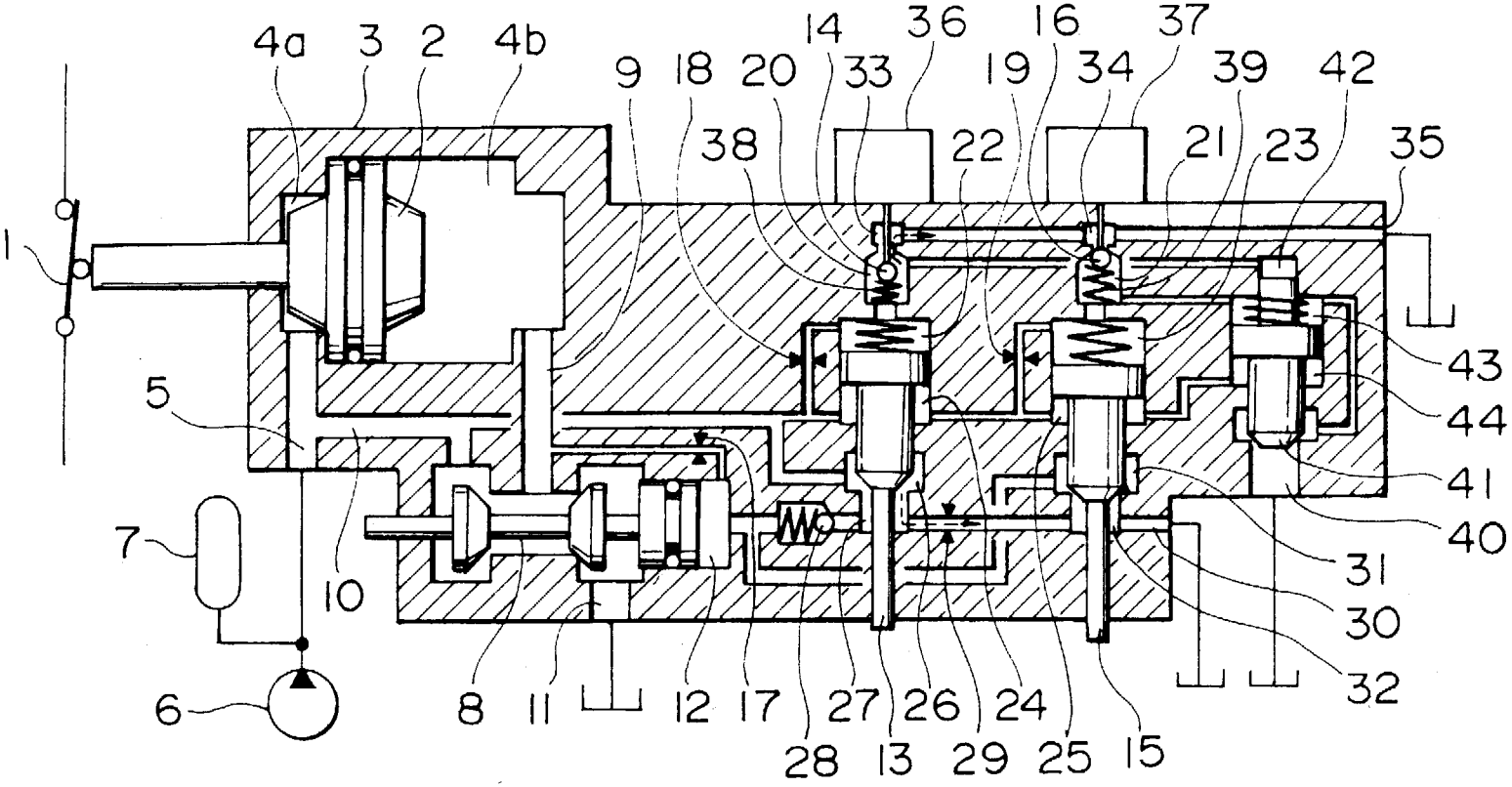
FIG. 5 is a structural view illustrating the embodiment shown in FIG. 1 in a condition in which an abnormality occurs in a circuit closing system.

In the circuit opening holding condition as shown in FIG. 3, when a circuit closing instruction is delivered, the circuit closing drive means 36 pushes the circuit closing pilot valve 14 for opening, and accordingly, the working fluid flows from the primary side 20 to the secondary side 33. At this time, the working fluid flows into through the restrictor valve 18, the primary side 20 and the first pilot chamber 22 of the circuit closing control valve 13 communicated with the primary side 20 become low pressure since the opening on the flow outlet side is greater than that of the flow inlet side, and accordingly, the circuit closing control valve 13 is opened by an actuating force applied from the second pilot chamber 24.

When the circuit closing control valve 13 is opened, the working fluid is fed from the supply port into the pilot chamber 12 of the main control valve by way of the primary side 26 and the secondary side 27 and the check valve 28 so that a high pressure is effected, and accordingly, the main control valve 8 is changed over into the circuit closing position. Thus, the working fluid is fed into the actuating chamber **4*b* of the hydraulic cylinder 3 so that a high pressure is effected therein, and accordingly, a force produced at the small pressure receiving are a side 4*a* is overcome so that the piston 2 initiates the circuit closing operation, that is, the condition shown in FIG. 4** is effected.

When the circuit closing instruction is canceled so that the drive force of the circuit closing drive means 36 is eliminated, the circuit closing pilot valve 14 is pressed by the spring 38 for closing. Then, the working fluid is fed through the restrictor valve 18 so that the primary side 20 becomes a high pressure, and accordingly, the circuit closing pilot valve 14 is more firmly held in the closing holding condition. Further, since the first pilot chamber 22 of the circuit closing control valve 13 also becomes a high pressure, the circuit closing control valve 13 is closed overcoming the actuating force of the second pilot chamber 24. However, since the pilot chamber 12 of the main control valve is connected to the control port 9 which has already become a high pressure, through the restrictor valve 17, the main control valve 8 is held at the circuit closing position, and accordingly, he piston 2 continues the circuit closing operation.

Further, the check valve 28 is pressed by a spring when the change-over of the control valve 8 into the circuit closing position is completed so that the pressure of the pilot chamber 12 of the main control valve becomes substantially equal to the supply pressure, and accordingly, the pilot chamber 12 of the main control valve is held at a high pressure although the circuit closing control valve 13 is closed while when the flowing from the primary side 26 is stopped, the working fluid flows from the primary side 21 to the return port 29 through the restrictor valve 29 so that the secondary side 27 become a low pressure. Thus, the circuit closing holding condition as shown in FIG. 1 is effected, and accordingly, power is fed.

During the above-mentioned circuit closing steps in series, the first pilot chamber 23 of the circuit closing control valve 15 and the second pilot chamber 43 of the lock valve 41 connected to the primary side 21 of the circuit opening pilot valve 16 are always held at a high pressure, and it can always overcomes the force of the third pilot valve 44 having a small pressure receiving area even though the first pilot chamber 42 connected to the primary side 20 of the circuit closing control valve becomes low pressure. Accordingly, the lock valve 41 will not be opened.

As mentioned above, the lock valve 41 in the present embodiment is not opened in the normal condition.

Next, explanation will be made of the operation and technical effects of the lock valve in the present embodiment.

Estimation is made such that an abnormality occurs in the circuit closing system, and accordingly, the circuit closing system valves is left in the circuit closing condition in the case of the circuit closing hold condition, that is, the circuit closing pilot valve 14 is left to be opened so that the primary side 20 and the first pilot chamber 22 of the circuit closing control valve 13 communicated with the primary side 20 become a low pressure, and accordingly, the circuit closing control valve 13 is left to be opened. At this time, the first pilot chamber 42 of the lock valve 41 connected to the primary side 20 of the circuit closing pilot valve 14 becomes low pressure. However, since the first pilot chamber 23 of the circuit opening control valve 15 and the second pilot chamber 43 connected to the primary side 21 of the circuit opening pilot valve 16 are held at a high pressure and the actuating force of the third pilot chamber 44 has a small pressure receiving area than that of the second pilot chamber 43. Thus, the lock valve 41 is left to be closed and will not be open.

Meanwhile, since the check valve 28 has already been closed and further, since the pilot chamber 12 of the main control valve is connected to the control port 9 at a high pressure through the restrictor valve 17, the main control valve 8 is held at the circuit closing position. Accordingly, the circuit closing condition is held similar to the normal condition, except that the working fluid continuously leaks from the restrictor valve 18 to the return port 35 through the circuit closing pilot valve 14 and from the circuit closing control valve 13 to the return port 30 through the restrictor valve 29.

Figure 2:
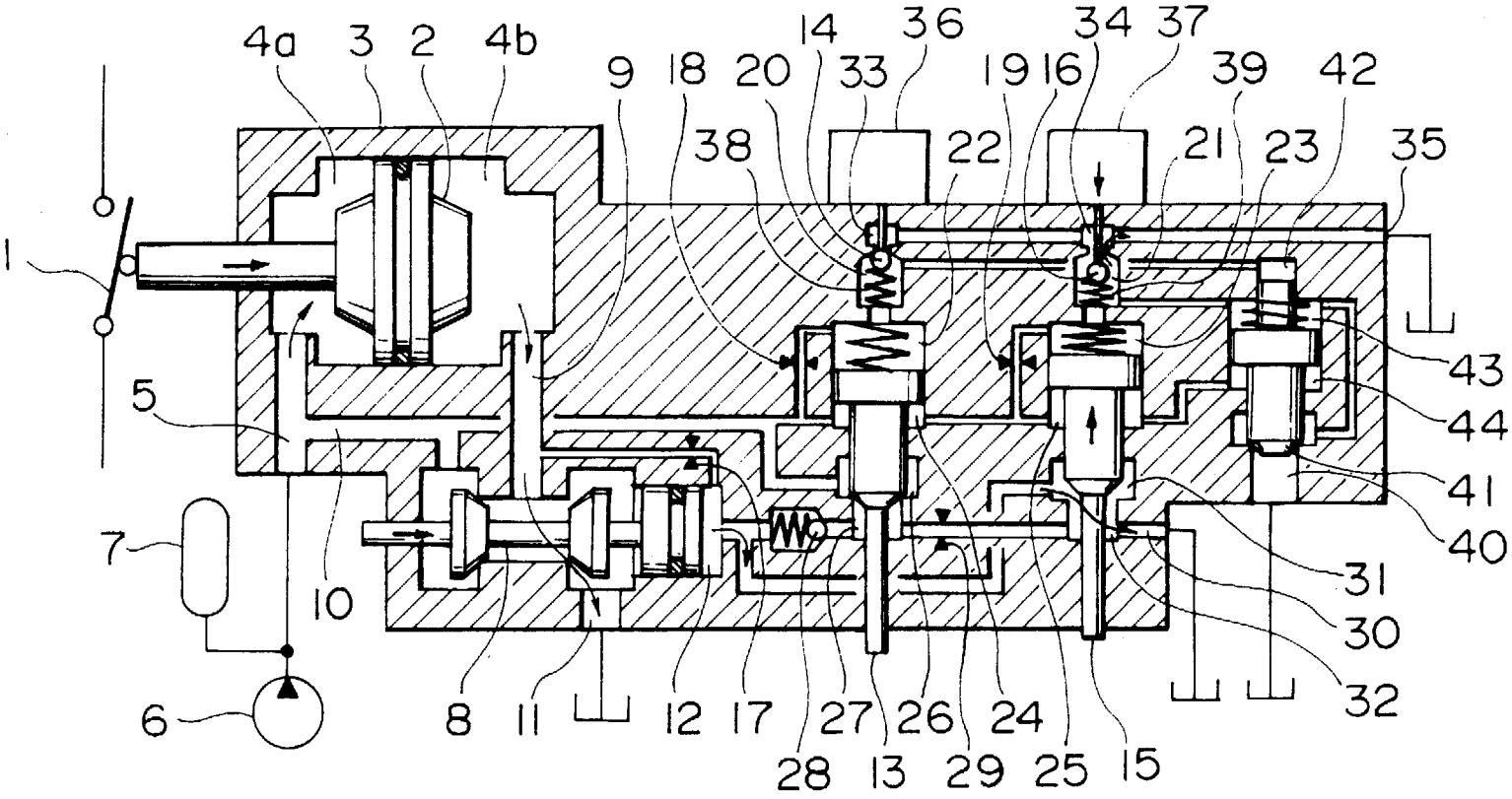
FIG. 2 is a structural view illustrating the embodiment shown in FIG. 1 in a normal circuit opening condition.
Figure 6:
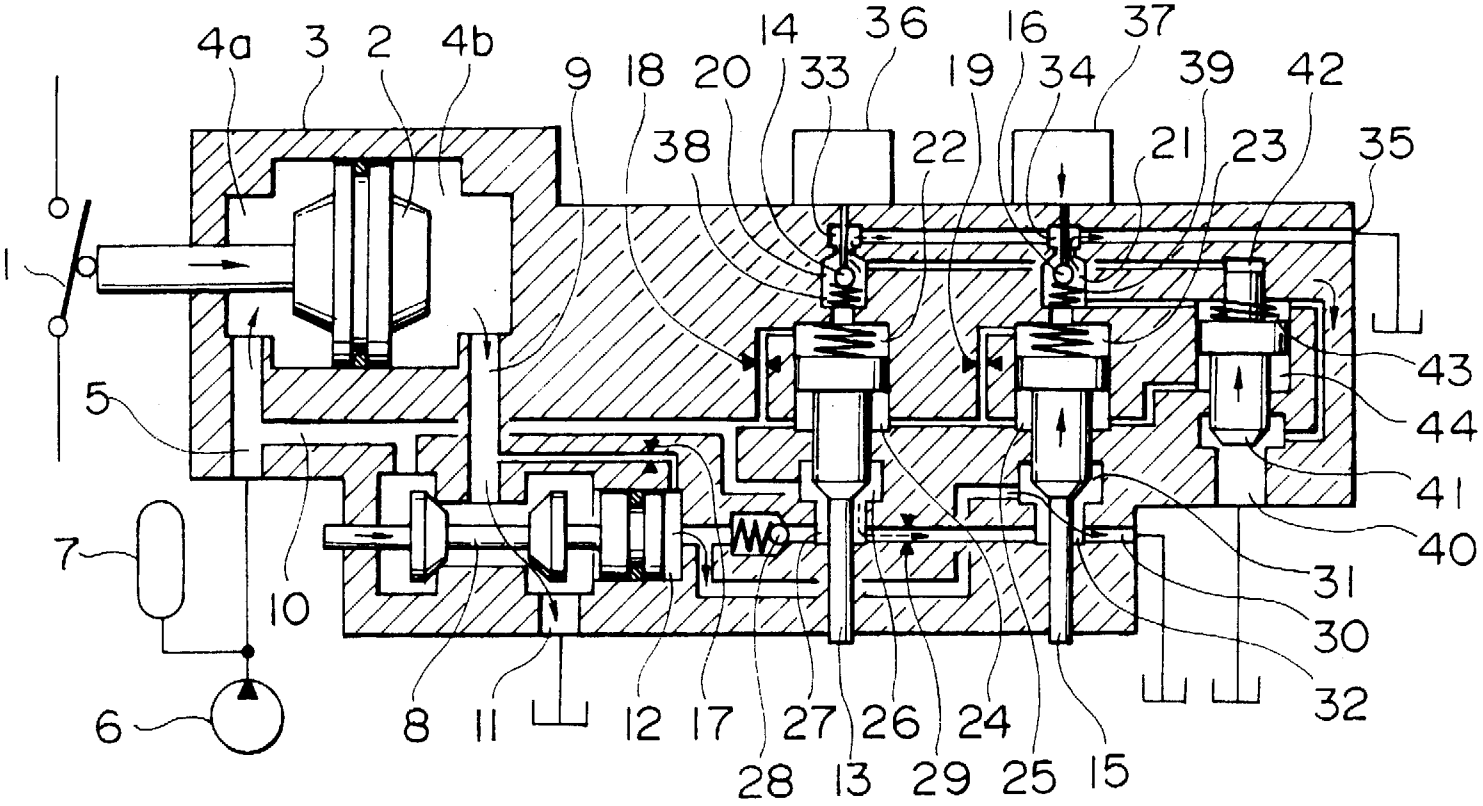
FIG. 6 is a structural view showing a condition in which the circuit opening operation is carried out from the condition shown in FIG. 5.

When the circuit opening instruction is delivered in this condition, as shown in FIG. 6, the circuit closing system valves carry out the same circuit opening operation as that shown in FIG. 2 while the first pilot chamber 23 of the circuit opening control valve 15 and the primary side 21 of the circuit opening pilot valve 16, and as well, the second pilot chamber 43 of the lock valve 41 connected thereto become a lower pressure, and accordingly, the lock valve 41 is opened by the actuating force of the third pilot chamber 44 since both first pilot chamber 42 and second pilot chamber 43 become a low pressure, and the first pilot chamber 23 of the circuit opening control valve 15 and the primary side 21 of the circuit opening pilot valve 16 are connected to the return port 40 so as to lower the pressure.

Thus, even though the circuit opening pilot valve 16 is closed when the circuit opening instruction is canceled, the working fluid flowing into through the restrictor valve 19 flows to the return port 90, and accordingly, the primary side 21 and the first pilot chamber 23 of the first circuit opening control valve 15 do not become a high pressure, and accordingly, the circuit opening control valve 15 is left to be opened even though the circuit opening operation is completed. Accordingly, even though the circuit closing system valves are left in the circuit closing condition since an abnormality is not eliminated even after completion of the circuit opening operation, the circuit closing operation is not started since the flow rate of the working fluid flowing out from the circuit opening control valve 15 is higher than that flowing into from the circuit closing circuit closing 13, and accordingly, the circuit closing operation is impossible, thereby it is possible to hold the circuit opening condition.

That is, according to the present embodiment, the circuit closing condition is held until the circuit opening instruction is delivered, and once the circuit opening operation is executed after the circuit opening instruction is delivered, the circuit closing operation becomes thereafter impossible in order to hold the circuit opening condition, thereby it is possible to prevent occurrence of an accident of erroneous operation in which the circuit closing operation unexpectedly happens after the circuit opening operation.

Further, when an abnormality in the circuit closing system is eliminated so that the circuit closing pilot valve 14 is normally closed, the first pilot chamber 42 of the lock valve 41 connected to the primary side 20 becomes a high pressure so that the lock valve 41 is closed overcoming the actuating force of the third pilot chamber 44, and accordingly, the primary side 21 of the circuit closing pilot valve 16 and the first pilot chamber 23 of the circuit opening control valve 15 are isolated from the return port 40 so as to become a high pressure, and further, the circuit opening control valve 15 is also closed. Thus, the normal circuit opening holding condition shown in FIG. 3 is recovered, and accordingly, the next circuit closing operation can be performed.

Next, a lock valve in another embodiment will be explained with reference to FIGS. 7 and 8.

This embodiment is the same as that of the embodiment shown in FIGS. 1 to 6, except that the structure of the poppet valve provided at the forward end of the middle diameter part of the lock valve 41 differs, and a passage connecting the primary side of the circuit opening pilot valve 16 communicated with the first pilot chamber 23 of the circuit opening control valve 16, to the return port 40 is formed in the valve element of the lock valve 41.

Since the hydraulic drive device for the circuit breaker is actuated at an extremely high speed, the pressure varies, resulting in the following problems. Since the first pilot chamber 42, the second pilot chamber 43 and the third pilot chamber 44 are all connected to the supply port, but only the third pilot chamber 44 is connected without through a restrictor valve, a pressure variation is transmitted in the third pilot chamber 44, faster than in the first pilot chamber 41 and the second pilot chamber 43.

Accordingly, the lock valve 41 would be possibly opened even through it is normally operated. Even though the lock valve 41 would be opened during the circuit opening operation, no problem would be raised since the operation can be normally executed. However, should the lock valve 41 be opened during the circuit closing operation, the working fluid would flow out from the first pilot chamber 23 of the circuit opening control valve 15 through the lock valve 41, and accordingly, a following problem would be raised, that is, the main control valve 8 cannot not be changed over into the circuit closing position, resulting in that the circuit closing operation can not be executed.

Accordingly, in this embodiment, the outer peripheral part 45 of the poppet at the forward end of the lock valve 41 is slidably fitted in a hole 46 with a predetermined gap therebetween. The shape of the hole 46 is selected so that the bore diameter of the hole 46 increases from a predetermined position as shown in FIG. 8 so that, even though the poppet is moved in its opening direction from its seating position as shown in FIG. 7, it is not soon opened, but it is opened after it comes to the predetermined position. Further, the part at which the bore diameter of the hole 46 increases is set to be the primary side, and this part is connected to the primary side 21 of the circuit opening pilot valve 16 communicated with the pilot chamber 23 of the circuit opening control valve 15.

According to this embodiment, the lock valve 41 is not soon opened even though it starts moving in the opening direction, and accordingly, the pressure in the first pilot chamber 23 of the circuit opening control valve 15 is not soon lost. Further, since a high pressure which has acted in the opening direction at a position radially outer than the valve seat is decreased, simultaneously with the opening of the valve seat, the closing force increases so that the valve element is pushed. Thus, the circuit closing control valve 13 is opened so as to complete the change-over of the main control valve 8 before the lock valve 41 comes to a position shown in FIG. 8, and accordingly, since a cause of erroneous operation such as pressure variation can be eliminated, the lock valve is returned into the closed condition without being opened, and the circuit closing operation can surely be executed. Further, since the time and speed of operation of the lock valve in this embodiment is not retarded by use of a restrictor valve or the like, but it may be sufficient to form the hole 46 in a shape such that the bore diameter of the hole 46 is enlarged at a position by a distance which is longer than a distance over which the lock valve is movable due to variation in pressure. Accordingly, it is not necessary to adjust the operational characteristic of the lock valve with the use of the restrictor valve, and further, the characteristic is not changed substantially due to variation in the viscosity of the working fluid caused by a temperature change and the abrasion caused by frequent use, thereby it is possible to provide a hydraulic drive device with a high degree of reliability.

Further, as in this embodiment, if the passage connecting between the primary side of the circuit opening pilot valve 16 communicated with the pilot chamber 23 of the circuit opening control valve 15, and the return port is formed in the valve element, the drilling process which has been complicated can be simplified, and further, positions where burrs which frequently cause erroneous operation are possibly formed can be reduced, thereby it is possible to enhance the reliability.

Next, explanation will be made of the other embodiment of the present invention with reference to FIGS. 9 and 10.

This embodiment is the same as the embodiment shown in FIGS. 1 to 6, except that the part to which the secondary side of the lock valve 41 is connected differs, and a cylindrical part 47 having a diameter equal to that of the valve seat is formed at the forward end of the poppet valve.

That is, in comparison with the aforementioned embodiment in which the secondary side of the poppet valve formed at the forward end of the middle diameter part of the lock valve 41 is connected to the return port, the secondary side of the poppet valve is connected, in this embodiment, to the primary side 31 of the circuit opening control valve 15 communicated with the pilot chamber 12 of the main control valve. Further, no high pressure is effected on the side of the cylindrical part 47 remote from the poppet valve.

Figure 9:
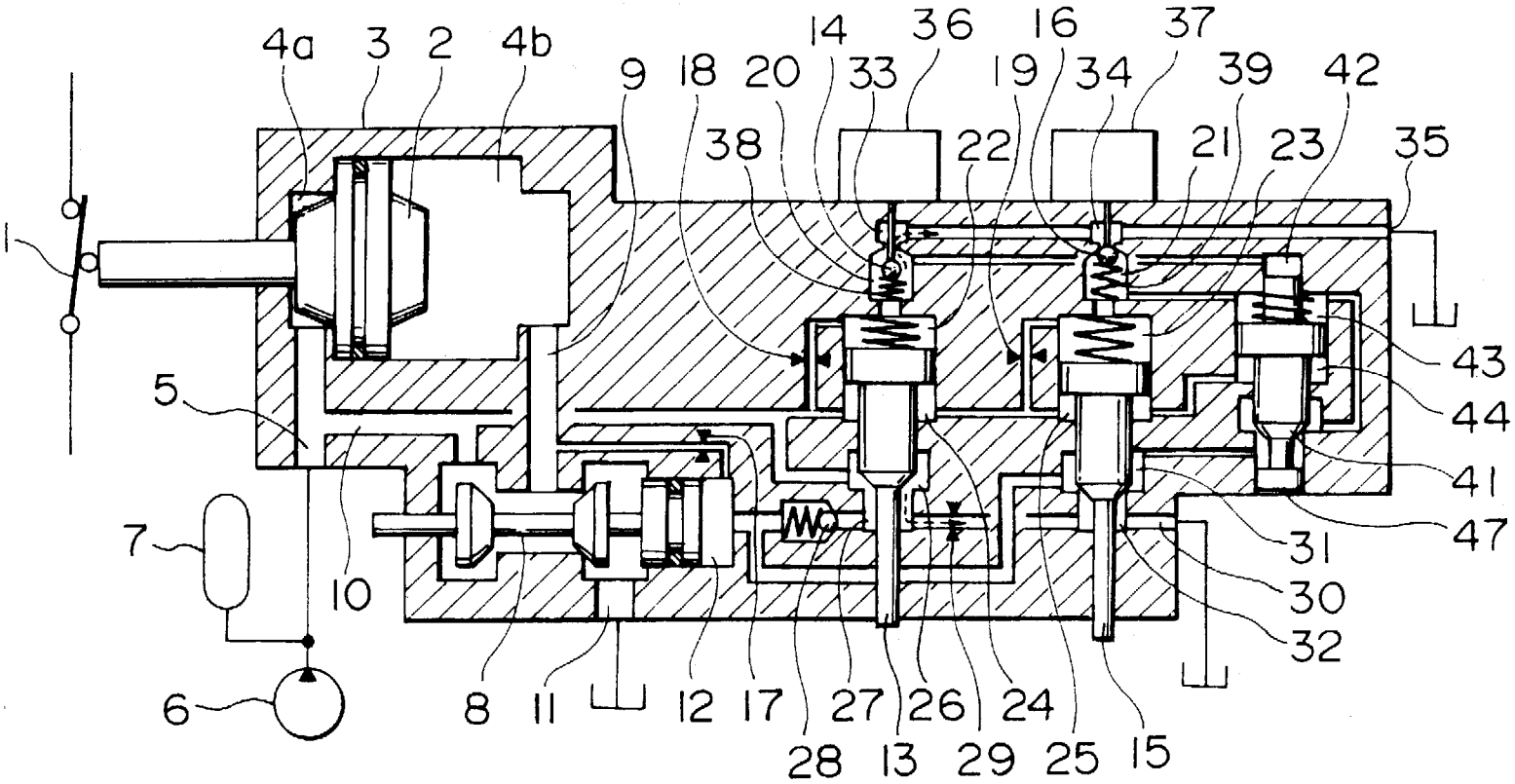
FIG. 9 is a structural view illustrating another embodiment of the present invention in a circuit closing holding condition in such a case that an abnormality occurs a circuit closing system.

Estimation is made such that an abnormality occurs in the circuit closing system, and accordingly, the circuit closing system valves are left in the circuit opening condition in the case of the circuit closing holding condition as shown in FIG. 9. In this condition, the first pilot chamber 23 of the circuit opening control valve 15 and the second pilot chamber 43 communicated with the primary side 21 of the circuit opening pilot valve 16 are held at a high pressure, and accordingly, the lock valve 41 is not opened but is left to be closed, without being overridden by the actuating force of the third pilot chamber 44 having a small pressure receiving area. Meanwhile, the check valve 29 has already been closed, and the pilot chamber 12 of the main control valve is connected to the control port 9 which is at a high pressure, through the restrictor valve 17. Thus, the main control valve 8 is held at the circuit closing position. Accordingly, similar to the aforementioned embodiment, the circuit closing condition is held in the same condition as the normal condition, except that the working fluid continuously leaks.

Figure 10:
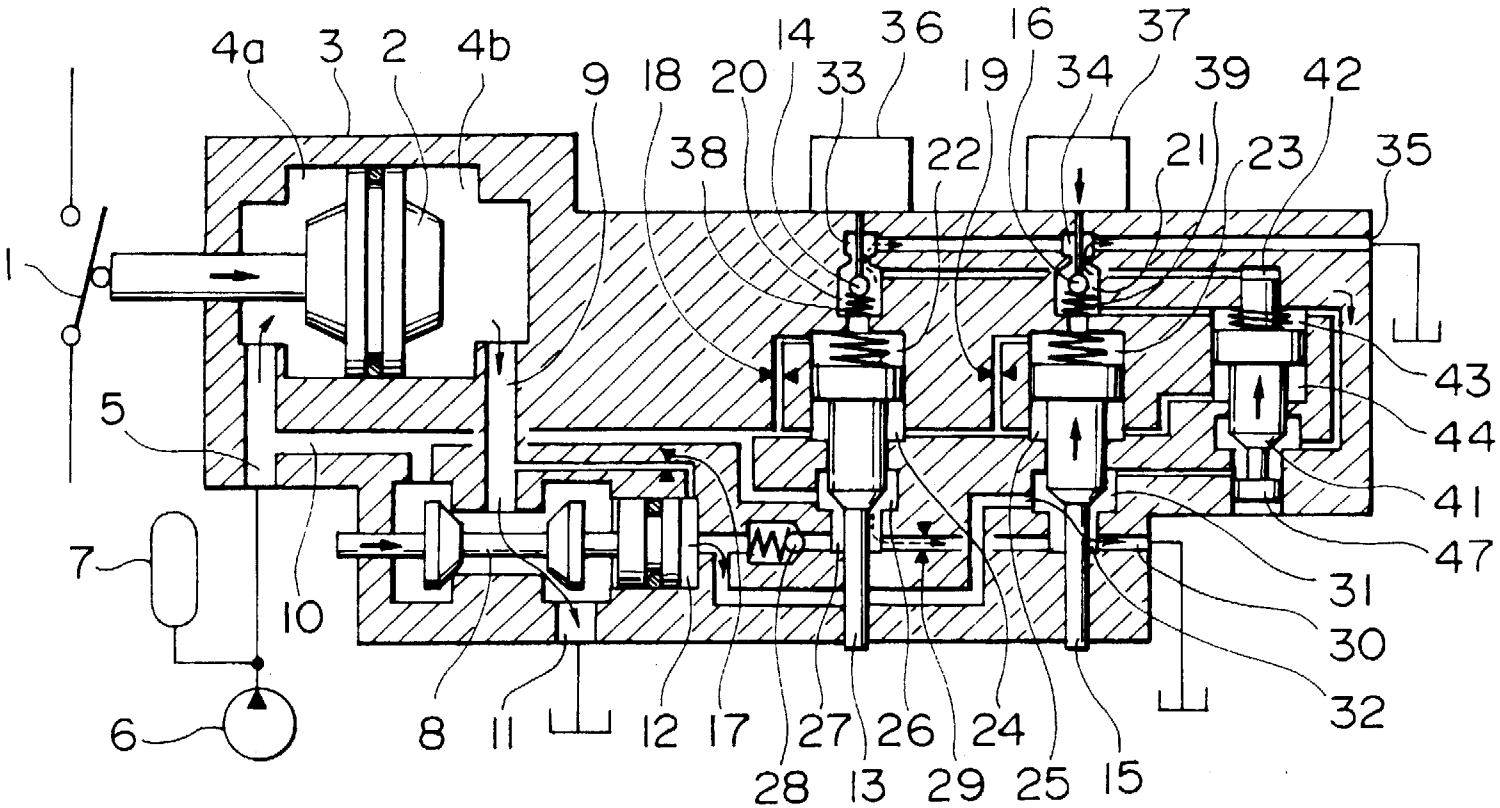
FIG. 10 is a structure view showing a condition in which the circuit closing operation from the condition shown in Fig. is carried out.

In this condition, when the circuit opening instruction is delivered, as shown in FIG. 10, the circuit opening operation the same as shown in FIG. 2 is carried out among the circuit opening system valves. Meanwhile, the first pilot chamber 21 of the circuit opening control valve 15 and the primary side 21 of the circuit opening pilot valve 16 as well as the second pilot chamber 43 of the lock valve 41 connected to them become a low pressure, and accordingly, both first pilot chamber 42 and second pilot chamber 43 of the lock valve 41 becomes a low pressure, and accordingly, the lock valve 41 is opened by the actuating force of the third pilot chamber 44. Thus, the first pilot chamber 23 of the circuit opening control valve 15 and the primary side 21 of the circuit opening pilot valve 16 are connected to the primary side 31 of the circuit opening control valve 15.

At this time, since the circuit opening control valve 15 has already been opened, the primary side 31 is connected to the return port 30 through the secondary side 32, and the primary side 31 is connected to the control port 19 which has already become a low pressure from the pilot chamber 12 of the main control valve through the restrictor valve 17. Thus, even though the circuit opening instruction is canceled so that the circuit opening pilot valve 16 is closed, the working fluid flowing into from the restrictor valve 19 flows out into the return port 30 through the primary side 31 and secondary side of the circuit opening control valve 15, and accordingly, since the primary side 21 of the circuit opening pilot valve 16 and the first pilot chamber 23 of the circuit opening control valve 15 do not become a high pressure, the circuit opening control valve 15 is left to be opened even though the circuit opening operation is completed. Thus, even though an abnormality would not be eliminated so that the circuit closing system valves are left in the circuit closing condition even after the completion of the circuit opening operation, the circuit opening operation is not initiated since the flow rate of the working fluid flowing out from the circuit opening control valve 15 is higher than that flowing into from the circuit closing control valve 13, and accordingly, the circuit opening operation becomes impossible, thereby it is possible to hold the circuit opening condition.

That is, in this embodiment, even though the circuit closing system is left in the circuit closing condition, the circuit closing condition is continuously held unless the circuit opening instruction is delivered, and once the circuit opening instruction is delivered so as to execute the circuit opening operation, since the circuit opening condition is held while the circuit closing condition is disabled it is thereafter possible to surely prevent occurrence of erroneous operation in which the circuit closing operation unexpectedly happens after the circuit opening operation.

Further, if an abnormality in the circuit closing system is eliminated so that the circuit closing pilot variable 14 is normally closed, the first pilot chamber 42 of the lock valve 41 communicated with the primary side 21 becomes a high pressure so that the lock valve 41 is closed, overcoming the actuating force of the third pilot chamber 44, and accordingly, the primary side 21 of the circuit opening pilot valve 16 and the first pilot chamber 23 of the circuit opening control valve 15 are isolated from the primary side 31 and secondary side 32 of the circuit opening control valve 15, and the return port 30 so as to become a high pressure. Thus, the circuit opening control valve 15 is also closed, the normal circuit opening holding condition similar to that shown in FIG. 3 is recovered, thereby the next circuit closing operation becomes possible.

Figure 7:
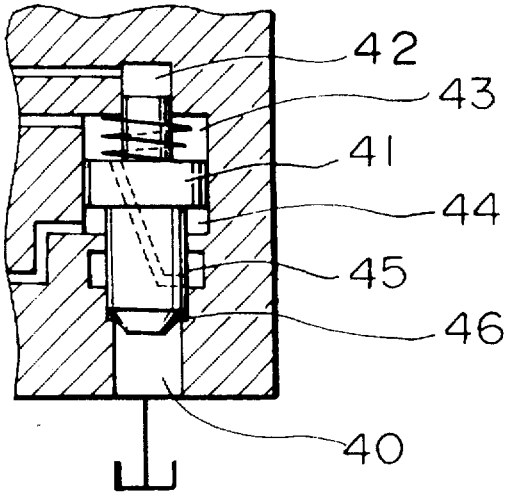
FIG. 7 is a structural view illustrating a lock valve according to the present invention, having another structure, in a closing condition.
Figure 8:
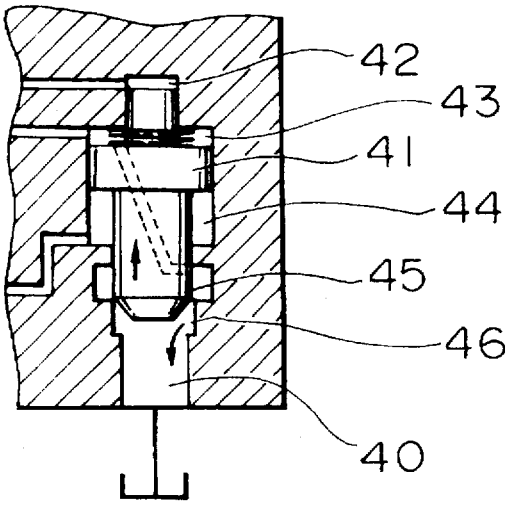
FIG. 8 is a structural view illustrating an opening position of the lock valve in the embodiment shown in FIG. 7.

Even in this embodiment, the poppet valve part of the lock valve 41 may have a structure the same as that in the embodiment shown in FIGS. 7 and 8 in which it is opened after it moves by a predetermined distance from the terminal end on the closing side. With this structure, the lock valve can be prevented from being erroneously operated due to variation in pressure during operation, or the like, thereby, it is possible to provide a hydraulic drive device with a high degree of reliability.

It is noted that, in the above-mentioned embodiment, a third operating mechanism composed of a mechanism using the resiliency of a spring, or the like may be used, instead of the third pilot chamber 44 of the lock valve 41. However, with the use of the above-mentioned hydraulic pilot control mechanism, a larger actuating force can be obtained, and further, the actuating force does not varies as the valve element displaces, that is, the it can be surely operated even though any resistant force is exerted while the speed of the operation can be enhanced with a high degree of reliability.

Further, in the lock valve in the embodiments as mentioned above, a pressure differential between the pilot chambers occurs in an extremely short operating period or only when an abnormality occurs, and further, it is arranged that all pilot chambers in the lock valve are held at a high pressure in the circuit closing holding condition and in the circuit opening holding condition having a long time. Accordingly, no leak occurs through an annular gap at the outer periphery of the valve element in the lock valve from the high pressure side to the low pressure side over a long time, and therefore, the working fluid is uselessly consumed while the operation of the lock valve is prevented from being hindered due to silting or hydraulic lock.

Further, in the lock valve in the embodiments as mentioned above, the small diameter part is used as the first pilot chamber 42 connected to the primary side 20 of the circuit opening pilot valve 14, and the part between the large diameter part and the small diameter part is used as the second pilot chamber 43 connected to the primary side 21 of the circuit opening pilot valve 16 which is communicated with the pilot chamber 23 of the circuit opening control valve 15. However, even though these are connected reversely, that is, the part between the large diameter part and the small diameter part is used as the first pilot chamber 42 while the small diameter part is used as the second pilot chamber 43, a similar erroneous operation preventing mechanism can be obtained. However, in this arrangement, if any abnormality occurs in the circuit closing system so that the primary side 20 of the circuit closing pilot valve 14 and the part between the large diameter part and the small diameter part serving as the first pilot chamber 42 becomes a low pressure, leakage occurs from both second pilot chamber 43 and the third pilot chamber 44 into the first pilot chamber 42 in the circuit closing holding condition, and accordingly, the volume of the leakage becomes larger.

Thus, a sufficient quantity of the working fluid cannot be reserved in the accumulator 7, and accordingly, the next cut-off operation cannot be sometimes executed. Alternatively, due to this reason, the discharge volume of the hydraulic pump 6 should be increased.

On the contrary, as mentioned above, if the small diameter part is used as the first pilot chamber while the part between the large diameter part and the small diameter part is used as the second pilot chamber, both third pilot chamber and second pilot chamber are held at a high pressure even though the circuit closing condition is held in a condition in which an abnormality occurs, and accordingly, no leakage occurs between the third pilot chamber and the second pilot chamber, but leakage occurs only from the second pilot chamber into the first pilot chamber. No defect will be caused. Accordingly, the arrangement described in the above-mentioned embodiments are preferable.

If, for example, foreign matter is caught between a ball and a valve seat in the circuit closing pilot valve 14 so that the ball cannot be completely seated, or if the ball or the valve seat is worn or missed so that the valve seat cannot be completely closed, the pressure of the first pilot chamber 22 of the circuit closing control valve 13, which is a supply pressure in the normal condition, is lowered and cannot attain an operation initiating pressure. Accordingly, a condition in which the circuit closing control valve 13 is not left to be opened, is effected. Although no accident of erroneous operation occurs only in this condition, but if this condition is left as it is, the abnormality progresses so that an accident possibly happens. Thus, such an arrangement that the lock valve 14 can be operated before the circuit closing control valve 13 is left to be opened, should be taken.

Figure 11:
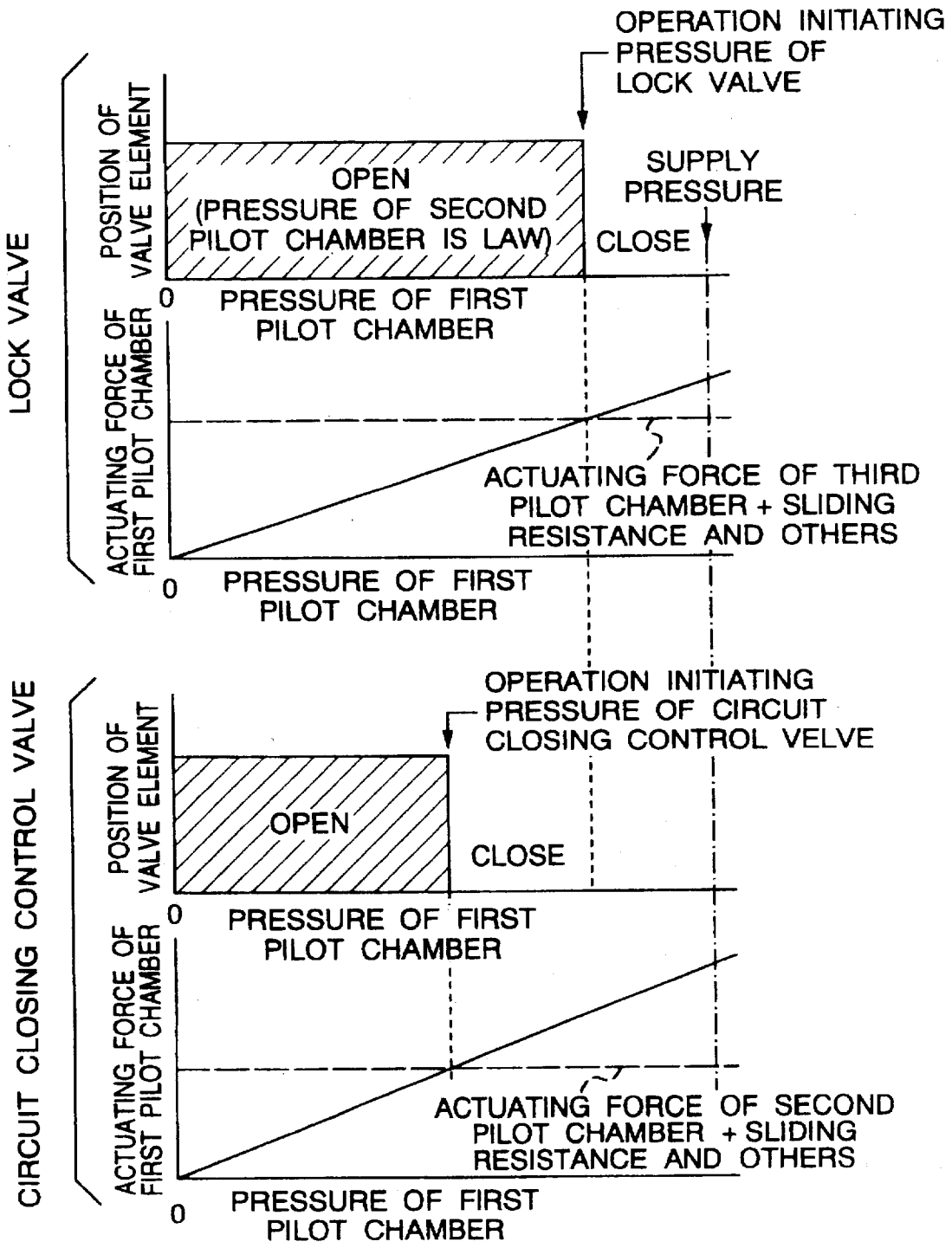
FIG. 11 is a characteristic view showing a relationship between the operation initiating pressures of the lock valve and a circuit closing control valve.

Thus, as shown in FIG. 11, the pressure of the first pilot valve 42 when he second pilot chamber 42 of the lock valve 41 becomes a low pressure so that the opening operation is initiated, that is, the operation initiating pressure of the lock valve 41 is set to be higher than the pressure of the first pilot chamber 22 of the circuit closing control valve 13 when the circuit closing control valve initiates the opening operation, that is, the operation initiating pressure of the circuit closing control valve 13.

The operation initiating pressure of the lock valve 41 is the pressure of the first pilot chamber 42 which is obtained when the actuating force of the first pilot chamber 42 in the opening direction is balanced with the actuating force of the third pilot chamber 44 in the opening direction in such a case that pressure of the first pilot chamber 42 of the lock valve 41 is gradually lowered in a condition in which the second pilot chamber 43 thereof is set at a low pressure. Meanwhile, the operation initiating pressure of the circuit closing control valve 13 is the pressure of the pilot chamber when the actuating force of the first pilot chamber 22 in the closing direction is balanced with the actuating force of the second pilot chamber 22 in the opening direction in such a condition that the pressure of the first pilot chamber 22 of the circuit closing control valve 13.

With this arrangement, even though the circuit closing control valve 13 is left to be opened due to an abnormality, if the circuit closing operation is executed in this condition, the lock valve is always operated through the opening operation in this condition, and accordingly, it is possible to surely prevent occurrence of an accident of erroneous operation in which the circuit closing operation unexpectedly happens after the completion of the circuit opening operation.

Figure 12:
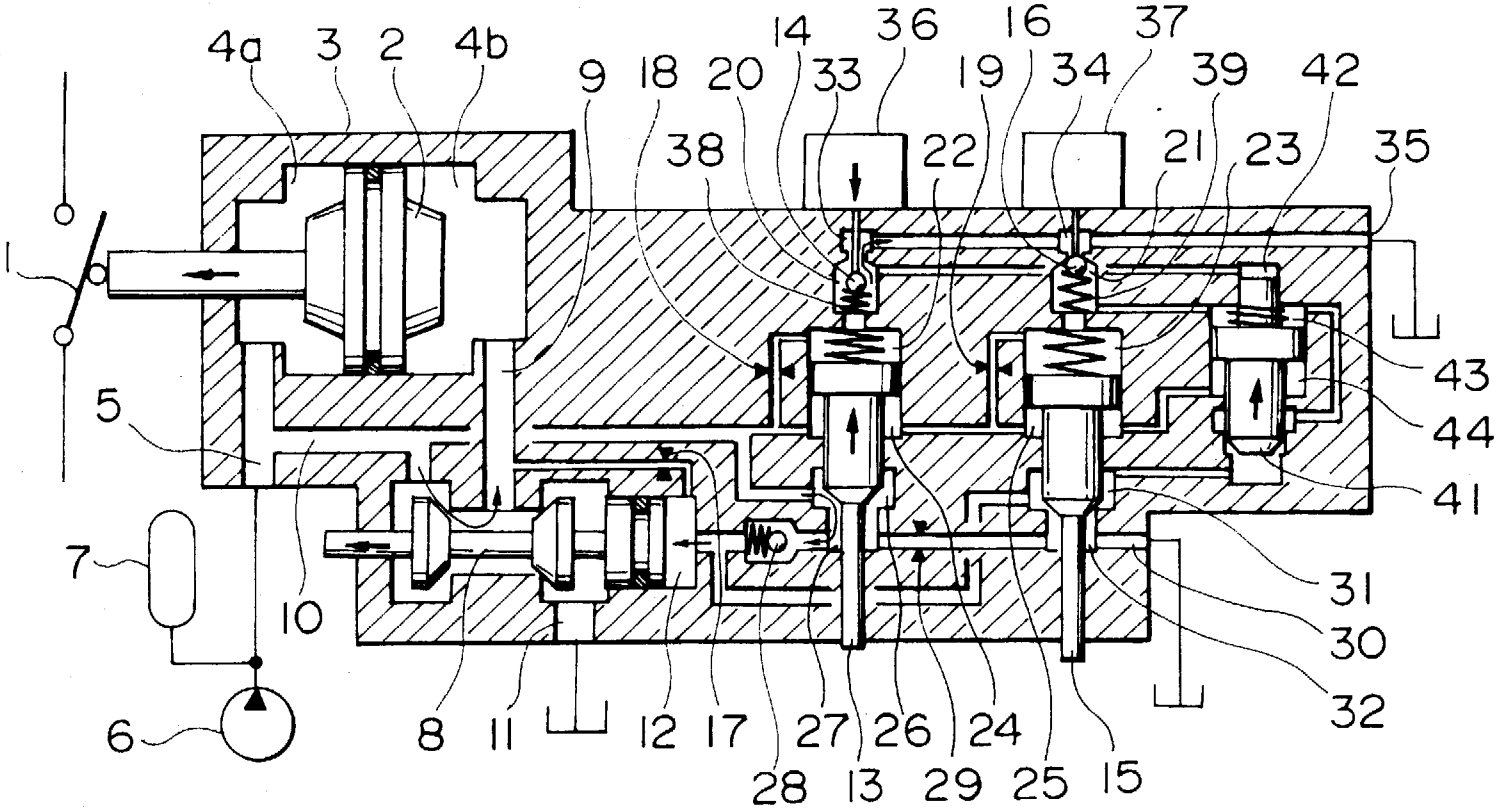
FIG. 12 is a structural view showing the other embodiment of the present invention in a normal circuit opening condition.

It is noted that the arrangement shown in FIG. 12 in which the cylindrical part 47 is removed from the forward end of the poppet valve part may be used in the arrangement shown in FIGS. 7 and 8 in which the lock valve 41 is opened after the poppet valve part of the lock valve 41 is moved by a predetermined distance from its seating position. With this arrangement, as shown in FIG. 12, although the lock valve is moved in the opening direction also during the normal circuit closing, since the circuit closing control valve 13 is opened before the lock valve 41 comes to its opening position so that the pilot chamber 12 of the main control valve becomes a high pressure, the working fluid does not flow out even if the lock valve 41 is opened, and accordingly, the first pilot chamber 23 of the circuit opening control valve 15 and the primary side 21 of the circuit opening pilot valve 16 are held at a high pressure. Thus, if the circuit closing pilot valve 14 is closed, the lock valve 41 is closed so that the circuit closing condition becomes effective.

Further, as in the above-mentioned embodiments, the lock valve 14 is preferably be arranged orthogonal to the piston 2 so that the lock valve 4 can be prevented from being erroneously opened due to disturbance such as shocks and vibration which occurs during operation of the piston 2, thereby it is possible to enhance the reliability.

Explanation will be made of a further embodiment of the present invention wit reference to FIGS. 13 and 14.

The this embodiment is the same as the embodiment shown in FIGS. 9 and 10, except that a stop valve 50 is used instead of the lock valve 41. That is the stop valve 50 is located in a passage connecting between the primary side 21 of the circuit opening pilot valve 16 communicated with the first pilot chamber 23 of the circuit opening control valve 15, and the primary side 31 of the circuit opening control valve 15.

Figure 13:
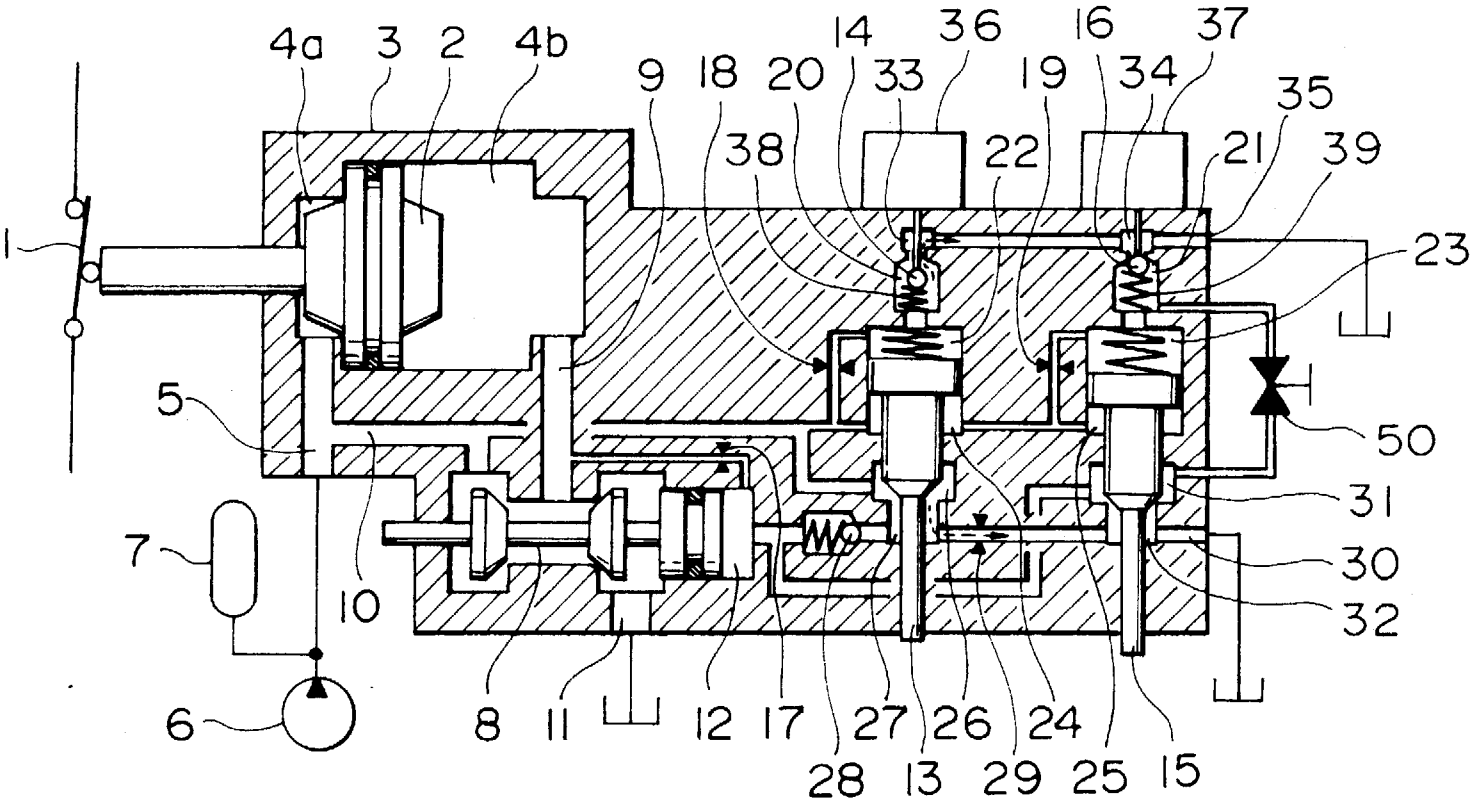
FIG. 13 is a structural view illustrating an another embodiment of the present invention in a circuit closing holding condition in a condition in which an abnormality occurs in a circuit closing system.

Estimation is made such that an abnormality occurs in the circuit closing system so that the circuit closing system valves are left in the circuit closing condition in the case of the circuit closing holding condition as sown in FIG. 13.

If the stop valve 50 is closed, similar the aforementioned embodiment, the circuit closing condition is held in this condition which is the same as the normal condition except that the working fluid continuously leaks from the restrictor valve 18 to the return port 35 through the closing pilot valve 14, and further, from the circuit closing control valve 13 to the return port 30 through the restrictor valve 29. When the stop valve 50 is opened, the first pilot chamber 23 of the circuit opening control valve 15 and the primary side 21 of the circuit opening pilot valve 16 are connected to the primary side 31 of the circuit opening control valve 15. Since the circuit opening control valve 15 closed in the circuit closing holding condition so that the primary side 31 communicated with the pilot chamber 12 of the main control valve become a high pressure, it is only resulted that the parts at the high pressure are connected together, and accordingly, no change occurs.

Figure 14:
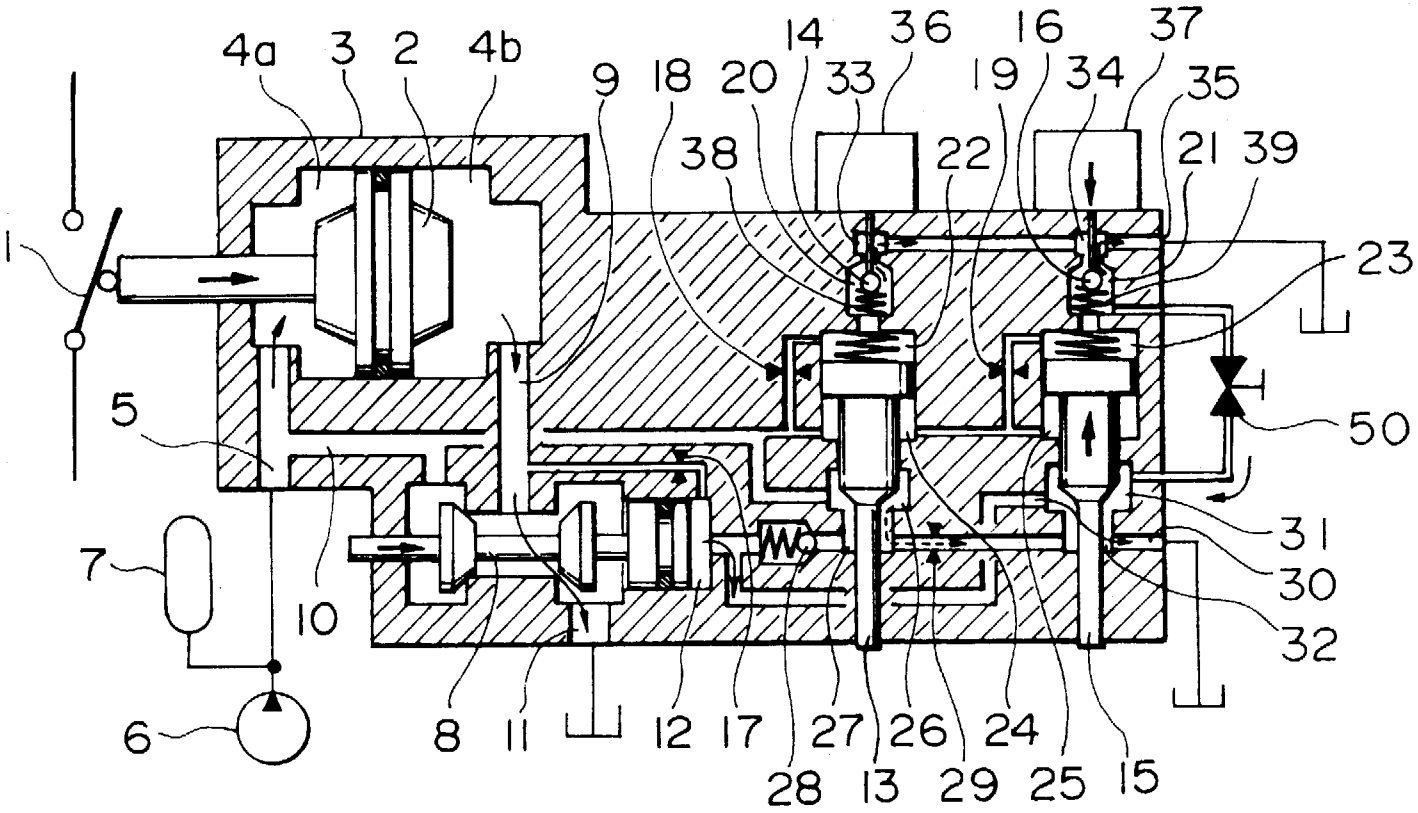
FIG. 14 is a structural view showing a condition such that a circuit opening operation from the condition shown in FIG. 3 is carried out.

When a circuit opening instruction is delivered, as shown in FIG. 14, the circuit opening system valves carry out the circuit opening operation the same as that shown in FIG. 2. Meanwhile, the first pilot chamber 23 of the circuit opening control valve 15 and the primary side 21 of the circuit opening pilot valve 16 are connected to the return port 30 through the primary side 31 of the circuit opening control valve 15 and the secondary side 32 thereof and through the stop valve 50. Further, the primary side 31 of the circuit opening control valve 15 is connected to the control part 19 which has become a low pressure through the pilot chamber 12 of the main control valve and the restrictor valve 17.

Accordingly, even though the circuit opening instruction is canceled so that the circuit opening pilot valve 16 is closed, the working fluid flowing into from the restrictor valve 19, flows out to the return port 30 through the stop valve 50 and the primary side 31 and secondary side 32 of the circuit opening control valve 15 and the primary side 21 of the circuit opening pilot valve 16 and the first pilot chamber 23 of the circuit opening control valve 15 do not become a high pressure, the circuit opening control valve 14 is left to be opened even though the circuit opening operation is completed.

Accordingly, even though an abnormality is not eliminated even after completion of the circuit opening operation so that the circuit closing system valves are left in the circuit closing condition, since the flow rate of the working fluid flowing out from the circuit opening control valve 15 is higher than that flowing into from the circuit closing control valve 13, the circuit closing operation is not initiated, that is, the circuit closing operation is impossible, thereby it is possible to hold the circuit opening condition.

That is, in this embodiment, even though the circuit closing system is left in the circuit closing condition, the circuit closing condition is continuously held unless the circuit opening instruction is delivered, and once the circuit opening instruction is delivered so as to execute the circuit opening operation, the circuit closing operation become impossible so as to hold the circuit opening condition, thereby it is possible to surely prevent occurrence of erroneous operation in which the circuit closing operation unexpectedly happens.

Further, if the stop valve 50 is closed after an abnormality in the circuit closing system is eliminated, the primary side 21 of the circuit opening pilot valve 16 and the pilot chamber 23 of the circuit opening control valve 15 communicated with the former, are isolated from secondary side 32 of the circuit opening control valve 15 and the return port 30, and accordingly, the first pilot chamber 23 of the circuit opening control valve 23 becomes a high pressure so that the circuit opening control valve 15 is closed, that is, a normal circuit opening condition similar to that shown in FIG. 3 is recovered, thereby it is possible to carry out the next circuit closing operation.

It is noted that a manual or motor driven stop valve can be used as the stop valve 50, and alternatively, a remote-control valve adapted to be opened in response to a signal from the outside, may be also used as the stop valve 50.

Finally, the explanation will be made of a further embodiment of the present invention with reference to FIG. 15.

This embodiment is the same as the embodiment shown in FIGS. 13 and 14, except that a monitor means 51 for monitoring the operating time or the operation frequency of the hydraulic pump 6 so as to issue an alarm if it is abnormal is provided, and a remote control device 52 for remote-controlling the stop valve 50 is provided.

Figure 15:
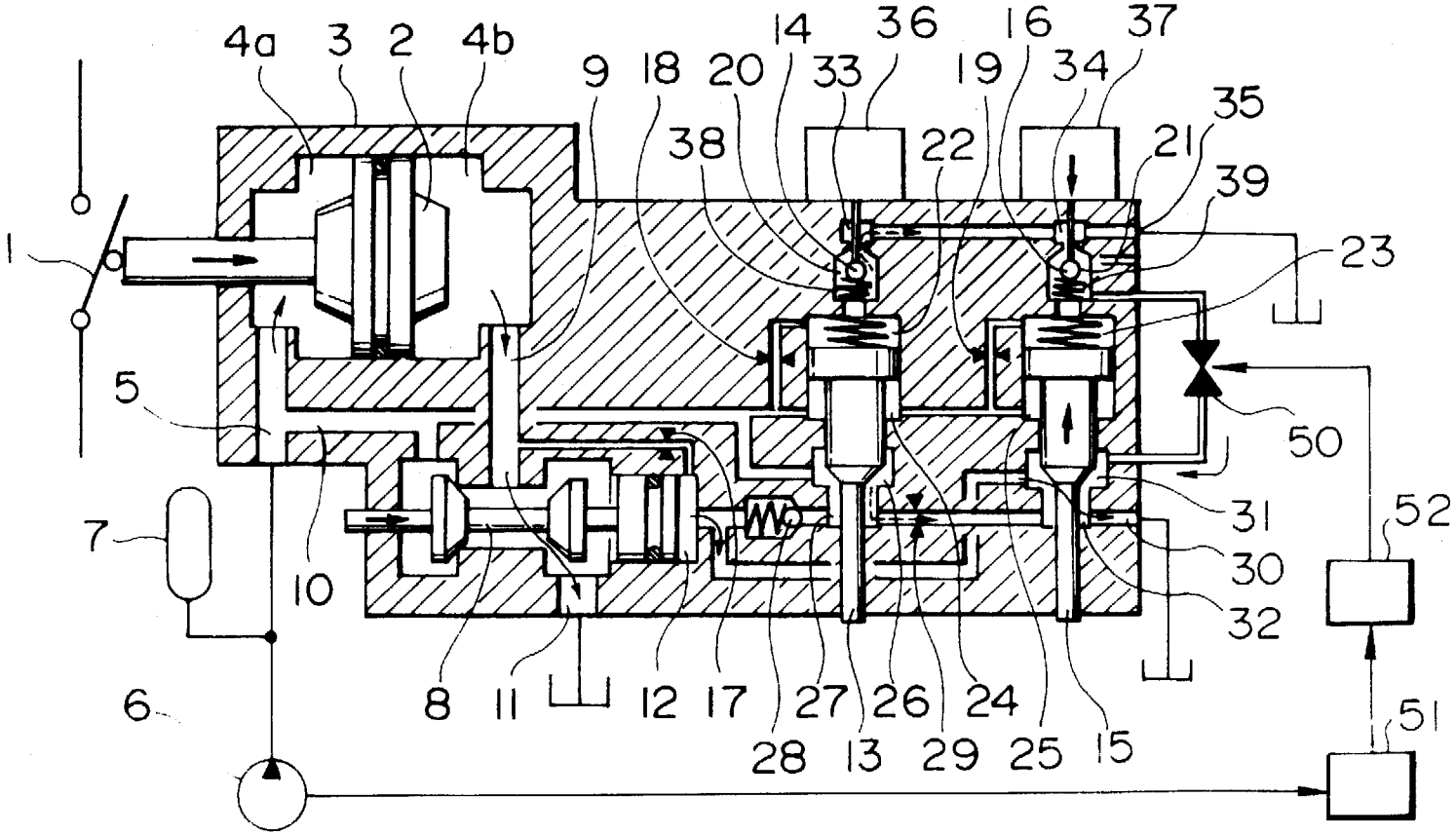
FIG. 15 is a structural view illustrating an arrangement in a further another embodiment of the present invention.

As shown in FIG. 15, if an abnormality occurs in the circuit closing system so that the circuit closing system valves are left in the circuit closing condition in the case of the circuit closing holding condition, the circuit closing condition is held as stated in the foregoing embodiment, and the working fluid continuously leaks from the restrictor valve 18 to the return port 35 through the circuit closing pilot valve 14 and from the circuit closing control valve 13 to the return port 30 through the restrictor valve 29. Thus, since the high pressure working fluid in the accumulator 17 decreases at a rate which is higher than that in the normal condition, the hydraulic pump 6 increases its operation frequency, and further, increases its operation time since the leakage occurs even during the operation. In the worst case, the operation is left to be continuously operated, or the operation is forcively stopped by a protecting circuit or the like since the operating time exceeds an upper limit value. Thereby pressure would be lost.

Accordingly, the monitor device 51 is provided so as to monitor either one or both of operation frequency or operation time of the hydraulic pump 6, and they are compared with an operation frequency and a operation time in the normal condition. If it is judged that an abnormality occurs, an alarm is issued, and in response to the alarm indicating that the abnormality occurs, a signal is delivered from the remote control device 52 for opening the stop valve 50. With this arrangement, it is possible to prevent occurrence of the erroneous operation in which the circuit closing operation unexpectedly happens after the circuit opening operation, even thought the circuit opening instruction is issued before the abnormality is eliminated. In particular, if it is arranged such that the remote control device 52 automatically open the stop valve 50 in response to an alarm indicating occurrence of an abnormality, and delivered from the monitor device 51, the stop valve 50 is more rapidly operated, thereby it is possible to more surely prevent occurrence of erroneous operation.

It is noted that the secondary side 32 of the circuit opening control valve 15 is always held at a lower pressure, and accordingly, the small diameter part may be eliminated. However, with the provision of the small diameter part easily facilitates confirmation for operation of the circuit opening control valve 15.

In the above-mentioned embodiments, if the circuit opening control valve executes the circuit opening operation in such a condition that the circuit closing control valve close the contact, the opening/closing operation of the valves may have structures which are different from those in the above-mentioned embodiment in order to operate the lock valve for holding the circuit opening condition after the operation of the circuit opening control valve.

What is claimed is:

1. A hydraulic drive device for a circuit breaker, comprising a hydraulic cylinder for opening and closing a contact, a hydraulic power source for pressurizing and feeding working fluid, control valves for controlling the flow of the working fluid fed from the fluid supply source so as to drive said hydraulic cylinder, characterized in that said control valves include at least one circuit closing system valve for causing the contact to fall into a circuit closing condition, and at least one circuit opening system valve for causing the contact to fall into a circuit opening condition, and means for holding the circuit opening condition of said at least one circuit opening system valve so as to disable the circuit closing operation for said at least one circuit closing system valve after the circuit opening operation in such a case that said at least one circuit opening system valve executes circuit opening operation when said at least one circuit closing system valve is in a circuit closing operation.

2. A hydraulic drive device as set forth in claim 1, characterized in that said means for holding the circuit opening condition of said circuit opening system valves so as to disable the circuit closing operation of said circuit closing system valves is a lock valve.

3. A hydraulic drive device for a circuit breaker, comprising a hydraulic cylinder for opening and closing a contact, a hydraulic power source for pressurizing and feeding working fluid, control valves for controlling the flow of the working fluid between a supply port from said hydraulic power source and a return post to said hydraulic power source so as to drive said hydraulic cylinder, characterized in that said control valves include a main control valve for controlling supply and discharge of the working fluid to and from said hydraulic cylinder;

a circuit closing control valve for connecting a pilot chamber in said main control valve to a supply port in response to a circuit closing instruction for said contact, and a circuit closing pilot valve for connecting a pilot chamber in said circuit closing control valve to a supply port in order to execute the connection between said pilot chamber of said main control valve and the supply port;

a circuit opening control valve for connecting said pilot chamber of said main control valve to said return port in response to a circuit opening instruction for the contact, and a circuit opening pilot valve for connecting a pilot chamber in said circuit opening control valve to the return port in order to execute the connection between said pilot chamber of said main control valve to said the return port;

a passage connecting said pilot chamber of said circuit opening control valve to the return port; and a lock valve located in said passage;

wherein said lock valve is opened when said pilot chamber of the circuit opening control valve is connected to the return port in a condition in which said pilot chamber of said circuit closing control valve is connected to the return port, so as to maintain the connection of said pilot chamber of said circuit opening control valve to the return port in order to disable the circuit closing operation of said circuit closing control valve.

4. A hydraulic drive device as set forth in claim 3, characterized in that a secondary side of said lock valve is connected to the return port, and said passage connects said pilot chamber of said circuit opening control valve to a primary side of said lock valve so that said pilot chamber of said circuit opening control valve is connected to the return port through opening operation of said lock valve.

5. A hydraulic drive device as set forth in claim 3, characterized in that said passage connects said pilot chamber of said circuit opening control valve to a primary side of said lock valve, and connects a secondary side of said lock valve to a primary side of said circuit opening control valve so that said pilot chamber of said circuit opening control valve is connected to the return port through opening operation of said lock valve and said circuit opening control valve.

6. A hydraulic drive device as set forth in claim 5, characterized in that said lock valve is a stop valve.

7. A hydraulic drive device as set forth in claim 6, characterized in that said stop valve is a valve adapted to be opened in response to an external instruction.

8. A hydraulic drive device as set fort in claim 6 or 7, characterized in that said hydraulic source is composed of a hydraulic pump for pressuring and discharging the working fluid, and an accumulator for accumulating the pressurized working fluid, said hydraulic pump starts its operation when the quantity of the working fluid accumulated at a high pressure in said accumulator decreases below a predetermined value, and stops its operation when the quantity of the working fluid therein comes to the predetermined value, and further, a monitor means for monitoring the operation time or operation frequency of said hydraulic pump, and for issuing an alarm when it is determined that the operation time or operation frequency is larger than a predetermined operation time or a predetermined operation frequency, is provided, whereby said stop valve is opened in response to said alarm issued from said monitoring means.

9. A hydraulic drive device as set forth in any one of claims 3 to 5, characterized in that said lock valve is a valve which is automatically opened in association with operation of a circuit opening pilot valve in such a case that said circuit opening pilot valve executes the circuit opening operation while a circuit closing pilot valve is in the circuit closing condition.

10. A hydraulic drive device as set forth in any one of claims 3 to 5, characterized in that said circuit closing pilot valve and said circuit opening pilot valve are connected at their primary side to the supply port through restrictor valves and at their secondary side to the return port, and said lock valve incorporates a first pilot chamber connected to the primary side of the said circuit closing pilot valve, a second pilot chamber connected to the primary side of said circuit opening pilot valve, and a third pilot chamber opposing said first and second pilot chambers across a valve element, having a pressure receiving area smaller than that of either one of said first and second pilot chambers, and connected to the supply port.

11. A hydraulic drive device as set forth in any one of claims 2 to 5, characterized in that said lock valve is a poppet valve having a bottom part formed therein with a valve seat, including a hole which receives therein a valve element of said lock valve and has a shape such that said hole has a constant inner diameter by a predetermined depth from said valve seat in a direction in which said valve element moves so that said valve element is slidably fitted in said hole, and an inner diameter larger than said constant inner diameter, further forward of said predetermined depth.

12. A hydraulic drive device as set forth in any one of claims 2 to 5, characterized in that said lock valve is provided so as to move in a direction orthogonal to a moving direction of said hydraulic cylinder.

13. A hydraulic drive device for a circuit breaker which executes a circuit opening operation for a contact, comprising a hydraulic cylinder for opening and closing a contact, a hydraulic power source for pressurizing and feeding working fluid, at least one circuit closing system valve for causing the contact to fall into a circuit close condition, and at least one circuit opening system valve for causing the contact to fall into a circuit opening condition, preferentially of circuit closing operation, characterized in that a circuit opening condition for said contact is maintained unless a circuit closing condition is released, in response to a circuit opening instruction when said contact is in the circuit closing condition.

14. A hydraulic drive device for a circuit breaker, comprising a hydraulic cylinder for opening and closing a contact, a hydraulic power source for pressurizing and feeding working fluid, control valves for controlling the flow of the working fluid between a supply port from said hydraulic power source and a return port to said hydraulic power source so as to drive said hydraulic cylinder, characterized in that said hydraulic cylinder having two actuating chambers, one of said two actuating chambers is connected to a supply port, a circuit closing operation being effected by feeding the working fluid into the other one of said two actuating chambers, and a circuit opening operation being effected by discharging the working fluid therefrom, said control valves comprises:

a main control valve for feeding and discharging the working fluid into and from said hydraulic cylinder, a circuit closing control valve connected at its primary side to the supply port, and at its secondary side to said pilot chamber of said main control valve and having a first pilot chamber connected to the supply port through a primary side of a circuit closing pilot valve and a restrictor valve, and a second pilot chamber connected to the supply port, opposing said first pilot chamber across a valve element, and having a pressure receiving area smaller than that of said first pilot chamber, for connecting said pilot chamber of said main control valve to the supply port when it is opened, so that the pilot chamber of said main control valve becomes a high pressure in order to change over said main control valve into a circuit closing position;

a circuit opening control valve connected at its primary side to said pilot chamber of said main control valve and at its secondary side connected to a return port, and having a first pilot chamber connected to the supply port through a primary side of a circuit opening pilot valve and a restrictor valve, and a second pilot chamber connected to the supply port and opposed to said first pilot chamber across a valve element, and having a pressure receiving area smaller than that of said first pilot chamber, for connecting said pilot chamber of said main control valve to the return port when it is opened, so that said pilot chamber of said main control valve becomes a low pressure in order to chamber over said main control valve into a circuit opening position, the circuit closing pilot valve connected at its primary side to said pilot chamber of said circuit closing control valve, and at its secondary side to the return port, and adapted to be opened in response to a circuit closing instruction so as to close said circuit closing control valve, and the circuit opening pilot valve connected at its primary side to said first pilot chamber of said circuit opening control valve and at its secondary side to the return port, and adapted to be opened in response to a circuit opening instruction so as to open said circuit opening control valve, there are provided a passage connecting the first pilot chamber of the circuit opening control valve and the primary side of said circuit opening pilot valve to the return port, and a lock valve for opening and closing said passage, said lock valve having a first pilot chamber connected to the primary side of said circuit closing pilot chamber, a second pilot chamber connected to the primary side of said circuit opening pilot valve, and a third pilot chamber connected to the supply port, having a pressure receiving area smaller than that of either one of said first and second pilot chambers, and opposed to said both first and second pilot chambers across a valve element.

15. A hydraulic drive device as set forth in claim 14, characterized in that a pressure in said first pilot chamber of said lock valve, when said lock valve starts its opening operation in a condition in which said circuit opening pilot valve is opened so that said second pilot chamber of said lock valve becomes a low pressure, is set to be higher than a pressure in first pilot chamber of said circuit closing control valve when said circuit closing control valve starts its opening operation.

16. A hydraulic drive device as set forth in claim 10, characterized in that a pressure in said first pilot chamber of said lock valve, when said lock valve starts its opening operation in a condition in which said circuit opening pilot valve is opened so that said second pilot chamber of said lock valve becomes a low pressure, is set to be higher than a pressure in first pilot chamber of said circuit closing control valve when said circuit closing control valve starts its opening operation.

17. A circuit breaker, comprising:

a contact movable between a closed position and an open position, a hydraulic cylinder for moving said contact between said open and closed positions, a hydraulic power source for pressurizing and feeding working fluid, control valves for controlling the flow of the working fluid between a supply port from said hydraulic power source and a return post to said hydraulic power source so as to drive said hydraulic cylinder, characterized in that said control valves include:

a main control valve for controlling supply and discharge of the working fluid to and from said hydraulic cylinder;

a circuit closing control valve for connecting a pilot chamber in said main control valve to a supply port in response to a circuit closing instruction for said contact, and a circuit closing pilot valve for connecting a pilot chamber in said circuit closing control valve to a supply port in order to execute the connection between said pilot chamber of said main control valve and the supply port;

a circuit opening control valve for connecting said pilot chamber of said main control valve to said return port in response to a circuit opening instruction for the contact, and a circuit opening pilot valve for connecting a pilot chamber in said circuit opening control valve to the return port in order to execute the connection between said pilot chamber of said main control valve to said the return port;

a passage connecting said pilot chamber of said circuit opening control valve to the return port; and a lock valve located in said passage;

wherein said lock valve is opened when said pilot chamber of the circuit opening control valve is connected to the return port in a condition in which said pilot chamber of said circuit closing control valve is connected to the return port, so as to maintain the connection of said pilot chamber of said circuit opening control valve to the return port in order to disable the circuit closing operation of said circuit closing control valve.

18. A circuit breaker, comprising:

a contact movable between a closed position and an open position, a hydraulic cylinder for moving said contact between said open and closed positions, a hydraulic power source for pressurizing and feeding working fluid, control valves for controlling the flow of the working fluid between a supply port from said hydraulic power source and a return port to said hydraulic power source so as to drive said hydraulic cylinder, characterized in that:

said hydraulic cylinder having two actuating chambers, one of said two actuating chambers is connected to a supply port, a circuit closing operation being effected by feeding the working fluid into the other one of said two actuating chambers, and a circuit opening operation being effected by discharging the working fluid therefrom, said control valves comprises:

a main control valve for feeding and discharging the working fluid into and from said hydraulic cylinder, a circuit closing control valve connected at its primary side to the supply port, and at its secondary side to said pilot chamber of said main control valve and having a first pilot chamber connected to the supply port through a primary side of a circuit closing pilot valve and a restrictor valve, and a second pilot chamber connected to the supply port, opposing said first pilot chamber across a valve element, and having a pressure receiving area smaller than that of said first pilot chamber, for connecting said pilot chamber of said main control valve to the supply port when it is opened, so that the pilot chamber of said main control valve becomes a high pressure in order to change over said main control valve into a circuit closing position;

a circuit opening control valve connected at its primary side to said pilot chamber of said main control valve and at its secondary side connected to a return port, and having a first pilot chamber connected to the supply port through a primary side of a circuit opening pilot valve and a restrictor valve, and a second pilot chamber connected to the supply port and opposed to said first pilot chamber across a valve element, and having a pressure receiving area small than that of said first pilot chamber, for connecting said pilot chamber of said main control valve to the return port when it is opened, so that said pilot chamber of said main control valve becomes a low pressure in order to chamber over said main control valve into a circuit opening position, the circuit closing pilot valve connected at its primary side to said pilot chamber of said circuit closing control valve, and at its secondary side to the return port, and adapted to be opened in response to a circuit closing instruction so as to close said circuit closing control valve, and the circuit opening pilot valve connected at its primary side to said first pilot chamber of said circuit opening control valve and at its secondary side to the return port, and adapted to be opened in response to a circuit opening instruction so as to open said circuit opening control valve, there are provided a passage connecting the first pilot chamber of the circuit opening control valve and the primary side of said circuit opening pilot valve to the return port, and a lock valve for opening and closing said passage, said lock valve having a first pilot chamber connected to the primary side of said circuit closing pilot chamber, a second pilot chamber connected to the primary side of said circuit opening pilot valve, and a third pilot chamber connected to the supply port, having a pressure receiving area smaller than that of either one of said first and second pilot chambers, and opposed to said both first and second pilot chambers across a valve element.

* * * * *